US007888840B2

(12) United States Patent
Shimaoka et al.

(10) Patent No.: US 7,888,840 B2
(45) Date of Patent: Feb. 15, 2011

(54) MICROPHONE AND A METHOD OF MANUFACTURING A MICROPHONE

(75) Inventors: Keiichi Shimaoka, Nagoya (JP); Hirofumi Funabashi, Nagoya (JP); Yasuichi Mitsushima, Hashima (JP); Toshiaki Nakagawa, Seto (JP); Toshihiro Wakita, Aichi-gun (JP); Shigeru Ando, Tokyo (JP); Nobutaka Ono, Tokyo (JP)

(73) Assignees: Kabushiki Kaisha Toyota Chuo Kenkyusho, Aichi-gun (JP); The University of Tokyo, Tokyo (JP)

( * ) Notice: Subject to any disclaimer, the term of this patent is extended or adjusted under 35 U.S.C. 154(b) by 1277 days.

(21) Appl. No.: 11/448,799

(22) Filed: Jun. 8, 2006

(65) Prior Publication Data

US 2006/0284516 A1 Dec. 21, 2006

(30) Foreign Application Priority Data

Jun. 8, 2005 (JP) ..... 2005-167742

(51) Int. Cl.
*H02N 2/00* (2006.01)
*H04R 25/00* (2006.01)

(52) U.S. Cl. ..... 310/309; 381/174

(58) Field of Classification Search ..... 381/174; 310/309

See application file for complete search history.

(56) References Cited

U.S. PATENT DOCUMENTS 4,491,697 A * 1/1985 Tanaka et al. ..... 381/113
4,597,099 A * 6/1986 Sawafuji ..... 381/190
6,159,761 A 12/2000 Okada (Continued)

FOREIGN PATENT DOCUMENTS

JP 58-114600 A * 7/1983 ..... 381/174

(Continued)

OTHER PUBLICATIONS

Ono et al; "Design and Experiments of Bio-mimicry Sound Source Localization Sensor with Gimbal-Supported Circular Diaphragm"; Transducers '03; The 12th International Conference on Solid State Sensors, Actuators and Microsystems; Boston; Jun. 8-12, 2003; pp. 939-942.

(Continued)

*Primary Examiner*—Thomas M Dougherty
(74) *Attorney, Agent, or Firm*—Oliff & Berridge, PLC

(57) ABSTRACT

A microphone that identifies the direction along which acoustic waves propagate with one diaphragm, and has superior durability is provided. The microphone includes a circular diaphragm supported at a center portion thereof. When the diaphragm receives acoustic waves, each position around the center thereof will vibrate with a phase depending upon the direction of the acoustic waves. First electrodes are arranged on one surface of the diaphragm and second electrodes are arranged facing corresponding first electrodes to form a first capacitor. Third electrodes are arranged on the other surface of the diaphragm and fourth electrodes are arranged facing corresponding third electrodes to form a second capacitor. A controller applies a voltage to the second capacitors so that the capacitance of the first capacitors will be constant and identifies the direction along which the acoustic waves propagate based on the difference in the voltages applied to each of the second capacitors.

19 Claims, 13 Drawing Sheets

U.S. PATENT DOCUMENTS

| | | | | |
|---|---|---|---|---|
| 6,584,206 | B2 * | 6/2003 | Ohashi | 381/191 |
| 6,833,687 | B2 * | 12/2004 | Landolt | 320/166 |
| 6,848,320 | B2 * | 2/2005 | Miyajima et al. | 73/763 |
| 2003/0015040 | A1 | 1/2003 | Ishio et al. | |
| 2003/0076006 | A1 | 4/2003 | Suzuki | |
| 2006/0053889 | A1 * | 3/2006 | Yamamoto et al. | 73/514.16 |
| 2008/0049954 | A1 * | 2/2008 | Hansen et al. | 381/174 |

FOREIGN PATENT DOCUMENTS

| | | |
|---|---|---|
| JP | A-10-308519 | 11/1998 |
| JP | A-2003-028740 | 1/2003 |
| JP | A-2003-127100 | 5/2003 |
| JP | 2007-267252 A * | 11/2007 |

OTHER PUBLICATIONS

Aug. 31, 2010 Office Action issued in corresponding Japanese Application No. 2005-167742 (with translation).

Akihito Saito et al., "Micro Gimbal Diaphragm for Sound Source Localization with Mimicking Ormia Ochracea," Proceedings of the 41st SICE Annual Conference, USA, Aug. 7, 2002, vol. 4, pp. 2159-2162.

Nobutaka Ono et al., "Theory and Experiment of Sound Source Localization Sensor by Gradient-Detection with Mimicking Ormia Ochracea," Institute of Electronics, Information and Communication Engineers (IEICE) Transactions on Communications, SP, Audios, Japan, IEICE, Mar. 22, 2002, vol. 101, No. 745, pp. 31-36.

* cited by examiner

MICROPHONE AND A METHOD OF MANUFACTURING A MICROPHONE

CROSS REFERENCE TO RELATED APPLICATION

This application claims priority to Japanese Patent Application No. 2005-167742 filed on Jun. 8, 2005, the contents of which are hereby incorporated by reference into the present application.

BACKGROUND OF THE INVENTION

1. Field of the Invention

The present invention relates to a microphone and a method of manufacturing a microphone.

2. Description of the Related Art

Microphones, which receive acoustic waves that propagate from a sound source and identify the direction along which the acoustic waves propagate, have been developed. The direction along which the acoustic waves propagate may be referred to hereinafter as the direction of the sound source. When the direction of the sound source can be identified, only the acoustic waves propagating from the sound source can be received, thus a microphone having directional characteristics can be realized. The technology regarding a microphone that identifies the direction of the sound source is disclosed in a publication titled "Design and Experiments of Bio-mimicry Sound Source Localization Sensor with Gimbal-Supported Circular Diaphragm", authored by Nobutaka ONO, Akihito SAITO, and Shigeru ANDO, published in the Proceeding of The 12th International Conference on Solid-State Sensors, Actuators and Microsystems, Boston Jun. 8-12, 2003, pp. 939-942.

Note that the word "microphone" in the present specification not only means a device that receives sound and converts that sound to electrical signals, but also a general concept that includes a device that identifies the direction of the sound source.

In the technology disclosed in the above publication, four electrodes are arranged on the rear surface (the surface opposite the surface which receives acoustic waves) of a diaphragm that is supported at the center portion thereof. The four electrodes are arranged at substantially equal intervals around the center portion of the diaphragm. Four other electrodes are arranged facing these four electrodes respectively. A gap of predetermined length is formed between each electrode arranged on the rear surface of the diaphragm and each electrode facing thereto. A voltage is applied between each electrode on the diaphragm and each electrode facing thereto. Thus, capacitors are formed by each electrode on the diaphragm and each electrode facing thereto. When the diaphragm vibrates, the length of the gap between each electrode on the diaphragm and each electrode facing thereto will change. The capacitance of the capacitor will change in response to the change in gap length.

When the microphone receives acoustic waves propagating from a certain direction, the diaphragm will vibrate. Because the diaphragm is supported at the center portion thereof, the periphery of the supported center portion will vibrate. The vibrations produced around the periphery of the diaphragm may not be uniform, and thus there will be regions distributed around the diaphragm in which the amplitude of the vibration is large, and other regions thereon in which the amplitude of the vibration is small. This distribution depends upon the direction of the sound source. On the other hand, the vibrations cause a change in the gap length between each electrode on the diaphragm and each electrode facing thereto. Thus, the distribution of the amount of change in the gap length will change depending upon the direction of the sound source. In other words, the distribution of the amount of fluctuation in the capacitance of each capacitor will also change depending upon the direction of the sound source. Thus, the direction of the sound source can be identified from the distribution of the amount of fluctuation in the capacitances of the capacitors.

BRIEF SUMMARY OF THE INVENTION

According to the technology in the above publication, the direction of the sound source can be identified with one diaphragm. A microphone that can identify the direction of the sound source can be reduced in size.

However, according to the technology in the above publication, the diaphragm is supported at the center portion thereof. Because of that, the displacement of the diaphragm during vibration due to acoustic waves will be larger as the distance from center portion to the displaced position being longer. Therefore, when the diaphragm vibrates for a long period of time, the diaphragm may deform from its initial shape due to fatigue. If the diaphragm deforms from its initial shape, the capacitance of each capacitor at the time when not receiving acoustic waves will also change. In this case, the identification of the direction of the sound source may become inaccurate. In other words, with the conventional technology, the microphone identifying the direction of the sound source by only one diaphragm may not have high durability. In order to increase durability, if the strength of the diaphragm is increased in the thickness direction thereof, it will become more difficult to vibrate. In this case, the displacement (the amplitude of the vibration) at each position of the diaphragm when receiving acoustic waves will be decreased thereby. The amount of fluctuation in the capacitance of the capacitors will be decreased. Accuracy on identifying the direction of the sound source will be lowered thereby.

Accordingly, there is a need for technology that will improve the durability of a microphone that can identify the direction of the sound source with only one diaphragm without lowering accuracy on identifying the direction of the sound source.

The amount of vibration to the diaphragm may be reduced as much as possible in order to inhibit deformation to the diaphragm that is caused by usage over a long period of time. Thus, the microphone may be controlled so as to inhibit vibration of the diaphragm. However, it will no longer be possible to identify the direction of the sound source if vibration of the diaphragm is simply inhibited.

Because the center portion of the diaphragm is supported, the periphery around the supported center portion of the diaphragm will vibrate. The vibrations produced around the periphery of the diaphragm are not uniform, and thus there will be regions distributed around the diaphragm in which the amplitude of the vibration is large, and other regions thereon in which the amplitude of the vibration is small. This distribution depends upon the direction along which the acoustic waves propagate. In order to inhibit the vibration of the diaphragm, a large amount of vibration suppression force must be applied to the regions in which the amplitude of the vibration is large. In addition, a small amount of vibration suppression force may be applied to the regions in which the amplitude of the vibration is small. Thus, the vibration suppression force that must be applied to each region of the diaphragm for inhibiting vibration of the diaphragm depends upon the direction along which the acoustic waves propagate (i.e., the direction of the sound source).

Accordingly, the inventors conceived of an idea by which the direction of the sound source could be identified from the vibration suppression force used to inhibit vibration of each position (region) of a diaphragm when the diaphragm receives acoustic waves.

When a diaphragm that is supported on the center portion thereof receives acoustic waves, each position of the periphery around the center portion of the diaphragm will vibrate with an amplitude that depends upon the direction of the sound source. In other words, each position of the diaphragm will be displaced in the thickness direction depending on the direction of the sound source. According to the present invention, the microphone will detect the displacement of each position on the diaphragm. Or, an element that outputs a quantity of electricity in response to the displacement of each position on the diaphragm will be provided.

According to the present invention, the displacement of each position on the diaphragm will be controlled so that the detected displacement of each position on the diaphragm will be a constant value (preferably, the amount of displacement will be zero). Or, the displacement of each position on the diaphragm will be controlled so that the quantity of electricity output in response to the displacement of each position on the diaphragm will be a constant value (preferably, an output value when the diaphragm is not receiving acoustic waves). Deformation of the diaphragm can be reduced by inhibiting vibration of the diaphragm.

Each position on the diaphragm will be displaced in the thickness direction depending on the direction of the sound source. In order to inhibit this displacement, the size of the vibration suppression force applied to each position on the diaphragm will depend on the direction of the sound source. Thus, the direction of the sound source can be identified from the difference in the sizes of the vibration suppression force applied to each position on the diaphragm. At this point, the size of the vibration suppression force applied to each position on the diaphragm will be substantially equal to the force that the diaphragm receives from the acoustic waves. The accuracy with which the direction of the sound source is identified, based upon the force that the diaphragm receives from the acoustic waves, will be substantially equal to the accuracy with which the direction of the sound source is identified based upon the vibration suppression force. This will make it possible to inhibit deformation caused by vibration of the diaphragm without reducing the accuracy with which the direction of the sound source is identified.

The microphone according to the present invention, has a diaphragm, first electrode pairs, second electrode pairs, and a controller. The diaphragm is supported at the center of the diaphragm. The diaphragm vibrates when the diaphragm receives acoustic waves.

Each of the first electrode pairs has a first electrode and a second electrode, and each of the second electrode pairs has a third electrode and a fourth electrode.

The first electrodes are arranged on a surface of the diaphragm at positions distributed around the center of the diaphragm. Each of the second electrodes is arranged at a position facing a uniquely corresponding first electrode to form a gap between each of the second electrodes and the corresponding first electrode. Each of the first electrode pairs forms a first capacitor.

The third electrodes are attached on a surface of the diaphragm at positions distributed around the center of the diaphragm. Each of the fourth electrodes is arranged at a position facing a uniquely corresponding third electrode to form a gap between each of the fourth electrodes and the corresponding third electrode. Each of the second electrode pairs forms a second capacitor.

The controller applies electric energy to each of the first capacitors and each of the second capacitors. Here, "electric energy" is an electric charge or voltage.

According to the configuration described above, the diaphragm is supported at the center thereof, and thus, the periphery around that center portion can be displaced in the thickness direction. Therefore, each position around the periphery of the center portion of the diaphragm will be displaced depending upon the direction of the sound source.

According to the configuration described above, each electrode pair of the first electrode pairs and the second electrode pairs will form a capacitor. The capacitor will change capacitance in accordance with the length of the gap between the electrodes. In addition, a coulomb force (electrostatic attraction force) will be generated that attracts both electrodes of the capacitor each other in accordance with the amount of electric energy (more specifically, the voltage or electric current) supplied to the capacitor.

The capacitors that are formed by each electrode pair of the first electrode pairs and the second electrode pairs can be used as sensors that can detect displacements of the diaphragm by measuring capacitances of the capacitors, because the capacitance of each capacitor will change in response to a change in each position of the diaphragm. In addition, the capacitors can also be used as actuators that can apply force to the diaphragm in response to the quantity of electric energy supplied to the capacitors. By employing the capacitors that are formed by each electrode pair of the first electrode pairs and the second electrode pairs as sensors or actuators, the microphone described above can be applied in a plurality of applications as a microphone that will identify the direction of the sound source.

The first electrodes of the first electrode pairs are arranged on a surface of the diaphragm at positions distributed around the center of the diaphragm. Each of the second electrodes is arranged at a position facing a uniquely corresponding first electrode to form a gap between each of the second electrodes and the corresponding first electrode. Thereby, each of the first electrode pairs forms a first capacitor. In a similar way, each of the second electrode pairs forms a second capacitor. The capacitance of each capacitor will change in response to the displacement of a position, at which the electrode is attached, of the diaphragm. At the same time, vibration of the diaphragm can be inhibited by adjusting the quantity of electric energy supplied to each capacitor by the controller. As a result, the direction of the sound source can be identified from the difference in the amount of electric energy supplied to each capacitor in order to inhibit the vibration of the diaphragm.

Furthermore, with the configuration described above, one of the electrodes of each electrode pair of the first electrode pairs and the second electrode pairs will be arranged on the diaphragm, and the other electrode will be arranged to form a gap between the one of electrodes and the other electrode. Both electrodes of each electrode pair can be placed into a non-contact state. Thus, the diaphragm can keep the portions thereof other than the center portion in a non-contact state. The periphery of the center portion of the diaphragm can receive acoustic waves and be made freely vibratable thereby. The direction of the sound source can be identified more accurately.

In the configuration described above, The first capacitors formed by the first electrode pairs will be used as a sensor that charges capacitance in response to the displacement of each position of the diaphragm. At the same time, the second capacitors formed by the second electrode pairs will be used as actuators that generate vibration suppression forces in order to inhibit the vibration of the diaphragm. The vibration suppression force is caused by electrostatic attraction force between electrodes of each second electrode pairs.

Because of the configuration described above, deformation due to the vibration of the diaphragm can be inhibited while identifying the direction of the sound source.

Furthermore, with the configuration described above, the first electrodes will be arranged on the diaphragm, and each of second electrodes will be arranged via a gap with the corresponding first electrode. Each of the first electrodes and the corresponding second electrode can be placed into a non-contact state. Similarly, each of the third electrodes and the corresponding fourth electrode can be placed into a non-contact state. Thus, the diaphragm can keep the portions thereof other than the center portion in a non-contact state. Other than the force caused by the acoustic waves and the force caused by the actuators, the diaphragm will be kept in a state in which an external force is not applied thereto. The direction of the sound source can be identified more accurately.

In addition, the microphone according to the present invention can attain an effect in which a wide dynamic range can be maintained thereby. In a conventional microphone, the width of the dynamic range is restricted by the size of the amplitude allowed by the diaphragm. In the microphone according to the present invention, vibration of the diaphragm is inhibited. Thus, even when acoustic waves having large amplitudes are received, the diaphragm will not be heavily vibrated. When acoustic waves having large amplitudes are received by the diaphragm, only the amount of electricity output to each actuator by the controller will increase. Therefore, the dynamic range of the acoustic waves capable of being received by this microphone can be increased.

The description above is one application of the microphone according to the present invention, but the present microphone can achieve other applications. For example, when the usage described in embodiments below is carried out, a microphone can be achieved which has strong directivity in front of the microphone.

The inventors have also created a manufacturing method that is useful to manufacture the microphone described above. By performing at least each of the following steps, the preferred diaphragm of the present invention can be obtained in which the center portion thereof is supported.

The manufacturing method of the present invention includes a step of forming a sacrifice layer on a surface of a semiconductor substrate so as to surround a predetermined region on the surface the semiconductor substrate, a step of forming a semiconductor layer covering the sacrifice layer and the surrounded region of the semiconductor substrate, and a step of removing the sacrifice layer by etching. The semiconductor layer corresponds to the diaphragm of the microphone.

According to the present manufacturing method, the semiconductor layer is formed on the sacrifice layer and the upper portion of the predetermined region of the semiconductor substrate, the region being exposed in the center of the sacrifice layer. Thus, the semiconductor layer forms a convex portion that points downward in the predetermined region. This convex portion is fixed on the surface of the semiconductor substrate, i.e., the center portion. In contrast, by removing the sacrifice layer, the periphery of the semiconductor layer (i.e., the periphery of the diaphragm) can be placed into a state in which the surface of the periphery does not come into contact with the semiconductor substrate that supports the semiconductor layer at its center portion. Due to the present manufacturing method, a diaphragm that is supported on the center portion thereof can be obtained. The steps described above can be performed by means of semiconductor process technology. Thus, a microphone can be manufactured that is extremely small in size.

According to the microphone of the present invention, vibration of a diaphragm supported on the center portion thereof will be inhibited when identifying the direction of the sound source. By inhibiting vibration of a diaphragm supported on the center portion thereof, the durability of the diaphragm can be improved. A microphone can be provided in which the durability thereof is improved without reducing accuracy when identifying the direction of the sound source.

In addition, according to the present invention, a manufacturing method suitable for manufacturing the microphone of the present invention is provided.

BRIEF DESCRIPTION OF THE DRAWINGS

FIG. 1(*b*) is a vertical cross-section view corresponding to line B-B shown in FIG. 1(*a*).

FIG. 1(*c*) is a vertical cross-section view corresponding to line C-C shown in FIG. 1(*a*).

FIG. 3(*b*) is a vertical cross-section view corresponding to line C-C shown in FIG. 1(*a*) when a sound source is in a Z direction.

FIG. 4(*b*) is a vertical cross-section view corresponding to line C-C shown in FIG. 1(*a*) when a sound source is in a direction that passes through the center of the diaphragm in a YZ plane, and is tilted at a predetermined angle from a Z axis.

FIG. 5(*b*) is a vertical cross-section view corresponding to line C-C shown in FIG. 1(*a*) when a sound source is in a direction that passes through the center of the diaphragm in a plane in which the XZ plane is rotated 45 degrees around the Z axis, and is tilted at a predetermined angle from a Z axis.

FIG. 6(*b*) is a vertical cross-section view corresponding to line D-D shown in FIG. 6(*a*).

FIG. 16(*b*) is a vertical cross-section view corresponding to line F-F shown in FIG. 15.

DETAILED DESCRIPTION OF THE INVENTION

Figure 1:
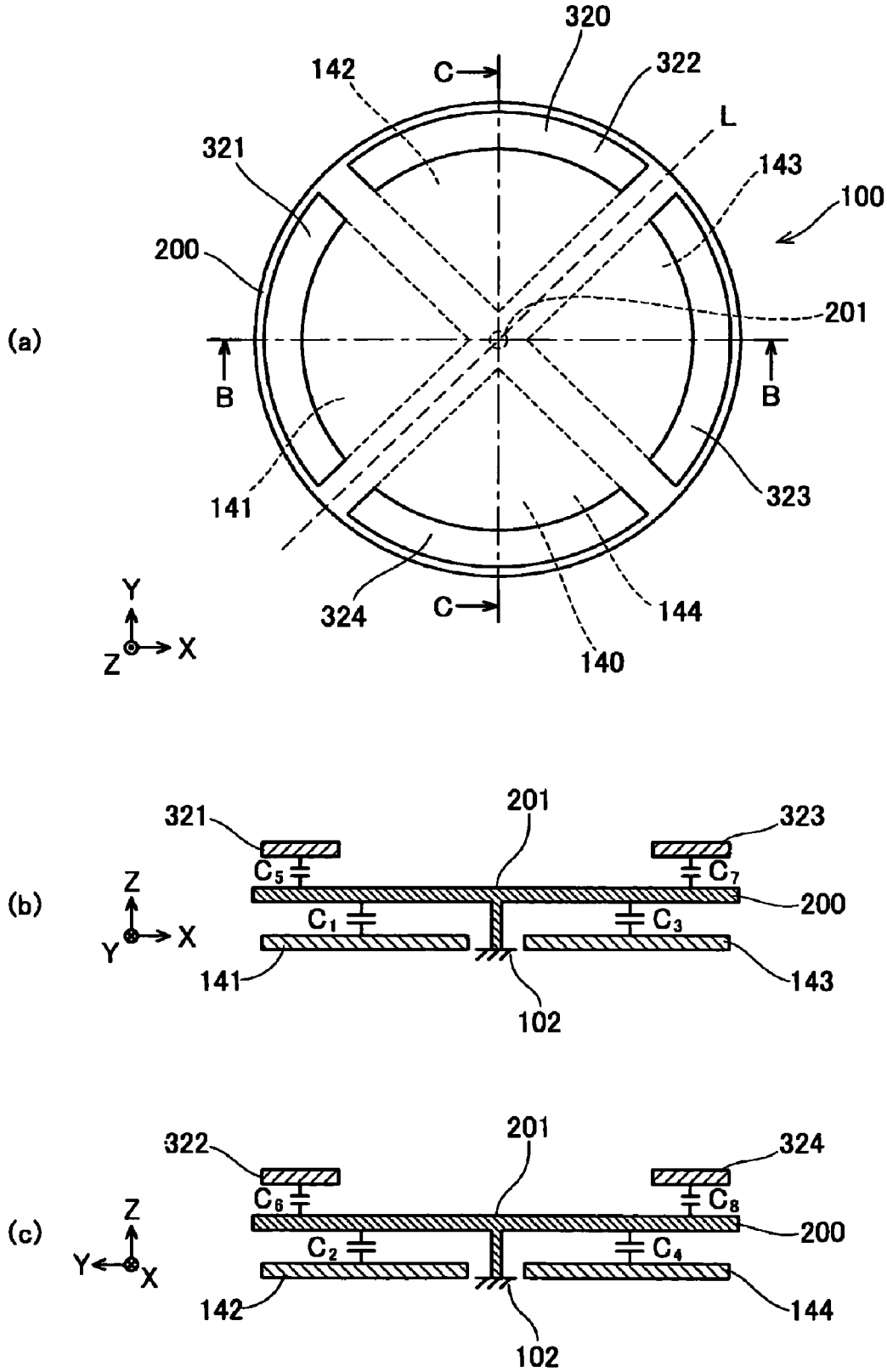
FIG. 1(*a*) is a plan view of a microphone of the first embodiment.

Drawings will be employed below to describe preferred technical features and preferred embodiments for carrying out the invention. Preferred technical features of the invention are described below.

In the microphone according to the invention, the controller preferably has following technical features. The controller may apply predetermined electric energy to each of the first capacitors. The controller may detect the capacitance of each of the first capacitors. The controller may apply electric energy to each of the second capacitors, and each electric energy applied to the corresponding second capacitor is independently controlled such that the detected capacitance of each first capacitor is maintained at a constant value. The controller may identify a direction along which the acoustic wave propagates based on values of the electric energies, each electric energy being applied to each of the second capacitors.

According to the configuration described above, the controller will apply predetermined electric energy to each of the first capacitors. Here, a "predetermined electric energy" is an electric current or voltage having a constant value. Or, it may be an electric current or voltage that changes over time. In either case, the controller will apply same quantity of electric energy to each of the first capacitors.

Then, the controller may detect the capacitance of each first capacitor. In other words, the first capacitors formed by the first electrode pairs will be used as sensors that output a capacitance that changes in response to the displacement of each position, at which corresponding first capacitor is arranged, of the diaphragm.

The controller may apply electric energy to each second capacitor so that the detected capacitance of each first capacitor is maintained at a constant value. In other words, the controller may apply electric energy to each second capacitor so as to cancel a variation of the detected capacitance. That is to say, the second capacitors formed by the second electrode pairs will be used as actuators that inhibit vibration of the diaphragm.

Each position of the diaphragm will be displaced depending upon the direction of the sound source. Therefore, in order to inhibit displacement (e.g., inhibit vibration) of each position of the diaphragm, the value (size) of the electric energy applied to each second capacitor arranged on each position on the diaphragm will depend on the direction of the sound source.

Therefore, the controller can identify the direction of the sound source from the difference in the value of the electric energy applied to each second capacitor.

Note that some or all of the first electrodes that are arranged on the diaphragm may be common electrodes. When some or all of the first electrodes arranged on the diaphragm are common, the common electrodes will be the ground side of the circuit. This is because the controller can detect the capacitance of each first capacitor formed by each first electrode pair, even when the first electrodes of the first electrode pairs are common. Some or all of the third electrodes that are arranged on the diaphragm may also be common electrodes because of same reason as the case of the first electrodes.

The first electrode pairs may be arranged on one side of the diaphragm, and the second electrode pairs may be arranged on the other side of the diaphragm. By arranging the first electrode pairs and the second electrode pairs on the front and rear sides of the diaphragm, the space that each of the electrodes occupy can be distributed on both sides of the diaphragm. The microphone can be reduced in size relatively to the size of the electrodes. In other words, above described configuration may allow efficient and effective utilization of front and rear surfaces of the diaphragm.

Furthermore, the first electrode pairs are preferably arranged on the rear side of the diaphragm, and the second electrode pairs are preferably arranged on the front side of the diaphragm. Here, the "front" means the side of the diaphragm that receives acoustic waves.

When the diaphragm receives acoustic pressure, the diaphragm will vibrate. When a larger acoustic pressure is continuously received, there will be a strong tendency for the diaphragm to bend strongly toward the rear side. A strong tendency for the diaphragm to bend strongly toward the rear side means that there will be a strong tendency for the length of the gap of each of electrode pair arranged on the front side to increase.

Capacitors that can generate an attraction force by applying electric energy cannot generate a repulsion force. Accordingly, the second electrode pairs that are used as actuators will be arranged on the front side of the diaphragm. A diaphragm having a strong tendency to bend toward the rear side can be suppressed with electrostatic attraction forces that attract the periphery of the diaphragm toward the front side.

On the other hand, the capacitance of a capacitor is inversely proportional to the length of the gap between both electrodes. The capacitance will rapidly increase as the length of the gap is shortened. The first electrode pairs that are used as sensors are arranged on the rear side of a diaphragm having a strong tendency to shorten the length of the gaps thereof. In this way, the sensitivity of the diaphragm to changes in capacitance in response to vibration can be increased. The control logic that maintains the capacitance of the first capacitors at a constant value can also be made highly sensitive. Therefore, the accuracy when identifying the direction of the sound source can be improved.

Both of the first electrode pairs and the second electrode pairs may be arranged on the same side of the diaphragm. For example, if the first electrode pairs and the second electrode pairs are arranged on the rear side of the diaphragm (the side opposite the surface of the diaphragm that receives acoustic waves), the acoustic waves can be received on the entire front surface of the diaphragm. The acoustic waves can be efficiently received. In addition, the thickness of the microphone can be further reduced by arranging the first electrode pairs and the second electrode pairs on the same side of the diaphragm.

The controller may identify the direction of the sound source from a phase difference between the electric energies, each electric energy being applied to each of the second capacitors.

The diaphragm will vibrate when acoustic waves are received thereby. Positions of the periphery of the diaphragm will vibrate with phase differences that depend upon the direction of the sound source. The capacitances of first capacitors will also change with phase differences that depend upon the direction of the sound source. The value of electric energy that is supplied to each second capacitor will also change with phase differences that depend upon the direction of the sound source, so that the capacitance of each first capacitor maintains a constant value. There is a predetermined relationship between the direction of the sound source and the phase of vibrations at each position. Based on this predetermined relationship, the direction of the sound source can be identified from the phase difference between the electric energies applied by the controller to each second capacitor. The direction of the sound source can also be identified by considering data changing over time, which is a phase difference. Therefore, the direction of the sound source can be identified more accurately.

The controller may apply bias electric energy to each of the second capacitors so that the capacitances of the first capacitors are to be substantially equal to each other when the diaphragm does not vibrate. In this case, the controller may calculate a value subtracting a value of each bias electric energy from a value of the electric energy being applied to the corresponding second capacitor while the diaphragm vibrates, and may identify the direction from the calculated values.

By applying bias electric energy, the capacitances of first capacitors when the diaphragm is not receiving acoustic waves can be equal to each other. Even if the diaphragm changes from its initial shape, the diaphragm can be returned to the initial shape by means of applied bias electric energy. In other words, the diaphragm can be maintained in substantially the initial shape even if the diaphragm vibrates for a long period of time. The accuracy on identifying the direction of the sound source can be hold by maintaining the diaphragm in the initial shape. The durability of the microphone can be improved.

When the direction of the sound source identified by the controller is substantially equal to a predetermined direction, the controller may output, to an external device, electric signal that corresponds to the electric energy being applied to one of the second capacitors. A microphone that detects acoustic waves propagating from the predetermined direction can be provided. In other words, a microphone having high directional characteristics can be provided. In this case, the controller outputs electric signal corresponding to the electric energy being applied to one of the second capacitors in order to inhibit the vibration of the diaphragm. A microphone having high directional characteristics while inhibiting the vibration of the diaphragm can be provided.

In addition, a microphone having strong directional characteristics in the front thereof can also be achieved by adding simple bridge circuit to the controller of the microphone of claim 1. This microphone may have following technical features.

The first electrode pairs may be arranged on one side of the diaphragm, and the second electrode pairs may be arranged on the other side of the diaphragm. The controller may have a bridge circuit with the first capacitors and the second capacitors. The bridge circuit may have a pair of input terminals and a pair of output terminals. The controller may apply predetermined electric energy to the first capacitors and the second capacitors via the pair of input terminals. The bridge circuit is formed so as to output electric signal to an external device via the pair of output terminals when the capacitances of the first capacitors change with substantially the same phase. Herein the outputted electric signal corresponds to a change of capacitance of at least one of the first capacitors.

Here, a "predetermined electric energy" applied by the controller via the pair of input terminals is a constant voltage or current.

In addition, both of the number of the first electrode pairs and the number of the second electrode pairs are preferably a multiple of 2 and the same number. This is because the bridge circuit can simply be constructed.

Here, the drawings will be employed to illustrate the operation of the bridge circuit. FIG. 1(*a*) is a plan view of the microphone 100. FIG. 1(*b*) is a vertical cross-section view corresponding to line B-B shown in FIG. 1(*a*). FIG. 1(*c*) is a vertical cross-section view corresponding to line C-C shown in FIG. 1(*a*).

The microphone 100 comprises a circular diaphragm 200. The diaphragm 200 is supported to a frame 102 of the microphone 100 at the center portion 201 of the diaphragm 200. The frame 102 is a member of the microphone 100 such as a case, a housing and the like, that will not vibrate even when the periphery of the diaphragm 200 vibrates due to receiving acoustic waves.

Four upper electrodes (fourth electrodes) 321, 322, 323, 324 are arranged facing the front surface of the diaphragm 200 (the surface that receives acoustic waves). The four upper electrodes 321, 322, 323, 324 are attached to a member (not shown in the drawings) of the microphone 100. The member is fixed relative to the frame 102, so the upper electrodes 321-324 will not vibrate even when the periphery of the diaphragm 200 vibrates due to receiving acoustic waves. Third electrodes (not shown in the drawings) are arranged on the front surface of the diaphragm 200. Each third electrode is arranged so as to face corresponding upper electrode. A gap of predetermined length is formed between each upper electrode and corresponding third electrode. Each upper electrode and corresponding third electrode form an electrode pair. A capacitor $C_5$ is formed by the electrode pair which comprises the upper electrode 321 and corresponding third electrode. Likewise, capacitors $C_6$, $C_7$, $C_8$ are formed by means of the upper electrodes 322, 323, 324 and corresponding third electrodes. The electrode pairs that form the four capacitors $C_5$, $C_6$, $C_7$, $C_8$ will be referred to as second electrode pairs. In addition, the four capacitors $C_5$, $C_6$, $C_7$, $C_8$ will referred to as second capacitors.

Four lower electrodes (second electrodes) 141, 142, 143, 144 are arranged facing the rear surface of the diaphragm 200. The four lower electrodes 141, 142, 143, 144 are also attached to the member (not shown in the drawings) of the microphone 100. The member is also fixed relative to the frame 102, so the lower electrodes 141-144 will not vibrate even when the periphery of the diaphragm 200 vibrates due to receiving acoustic waves. First electrodes (not shown in the drawings) are arranged on the rear surface of the diaphragm 200. Each first electrode is arranged so as to face corresponding lower electrode. A gap of predetermined length is arranged between each lower electrode and corresponding first electrode. Each lower electrode and corresponding first electrode also form an electrode pair. A capacitor $C_1$ is formed by the electrode pair which comprises the lower electrode 141 and corresponding first electrode. Likewise, capacitors $C_2$, $C_3$, $C_4$ are formed by means of the upper electrodes 142, 143, 144 and corresponding first electrodes. The electrode pairs that form the four capacitors $C_1$, $C_2$, $C_3$, $C_4$ will be referred to as first electrode pairs. In addition, the four capacitors $C_1$, $C_2$, $C_3$, $C_4$ will be referred to as first capacitors. Note that reference symbols $C_1$ to $C_8$ represent each capacitor and also represent the capacitance of each capacitor in this description.

Figure 7:
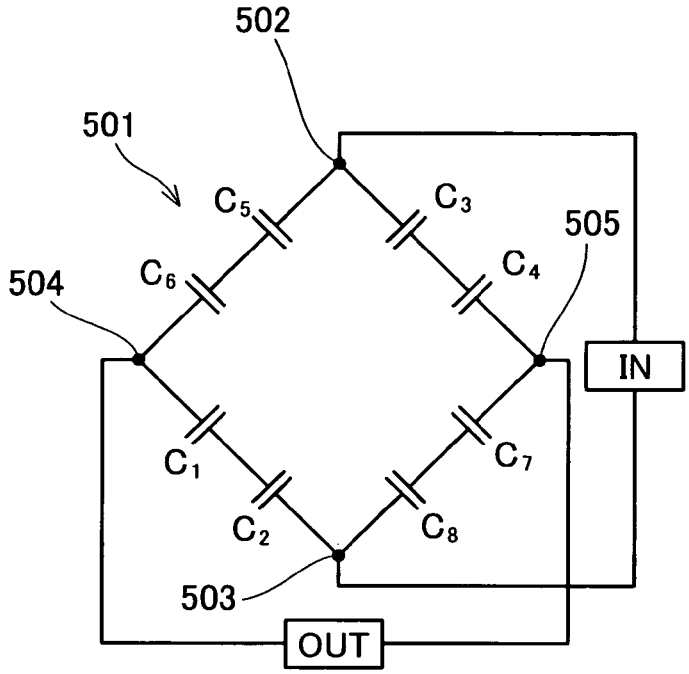
FIG. 7 is a drawing that describes a bridge circuit of the fifth embodiment.

The bridge circuit 501 depicted in FIG. 7 is constructed of the first capacitors $C_1$, $C_2$, $C_3$, $C_4$ and the second capacitors $C_5$, $C_6$, $C_7$, $C_8$.

The second capacitors $C_5$ and $C_6$ are connected in series between the first input terminal 502 and the second output terminal 504 of the bridge circuit 501. The second capacitors $C_7$ and $C_8$ are connected in series between the second input terminal 503 and the first output terminal 505.

In addition, the first capacitors $C_3$ and $C_4$ are connected in series between the first input terminal 502 and the first output terminal 505. The first capacitors $C_1$ and $C_2$ are connected in series between the second input terminal 503 and the second output terminal 504. A constant voltage or constant current will be applied between the first input terminal 502 and the second input terminal 503. Here, it is assumed that a constant voltage will be applied between the first input terminal 502 and the second input terminal 503.

When a sound source is in front of the diaphragm 200, the periphery of the diaphragm 200 around the center portion thereof will vibrate in the same phase. For example, consider the timing at which the entire diaphragm 200 bends toward the lower electrodes 140 side thereof during vibration. Note that the reference symbol 140 represents all of four lower electrodes 141-144. At this timing, the length of the gaps of the first electrode pairs that respectively form the first capacitors $C_1$, $C_2$, $C_3$, $C_4$ will shorten together. Thus, the capacitances of the first capacitors will increase together. In other words, the capacitances of the first capacitors will increase or decrease in the same phase.

In contrast, the length of the gaps of the second electrode pairs that respectively form the second capacitors $C_5$, $C_6$, $C_7$, $C_8$ will lengthen. Thus, the capacitances of the second capacitors will decrease together. At this timing, the capacitance between the first input terminal 502 and the second output terminal 504 of the bridge circuit 501 is different than the capacitance between the first input terminal 502 and the first output terminal 505 thereof. Therefore, an electric potential is produced between the second output terminal 504 and the first output terminal 505. A voltage will be outputted from between the second output terminal 504 and the first output terminal 505. The changes of the outputted voltage will synchronize with the increase or decrease of the capacitance of each capacitor of the first capacitors and the second capacitors. In other words, the outputted voltage is an electric signal to which the acoustic waves received by the diaphragm are converted.

Figure 4:
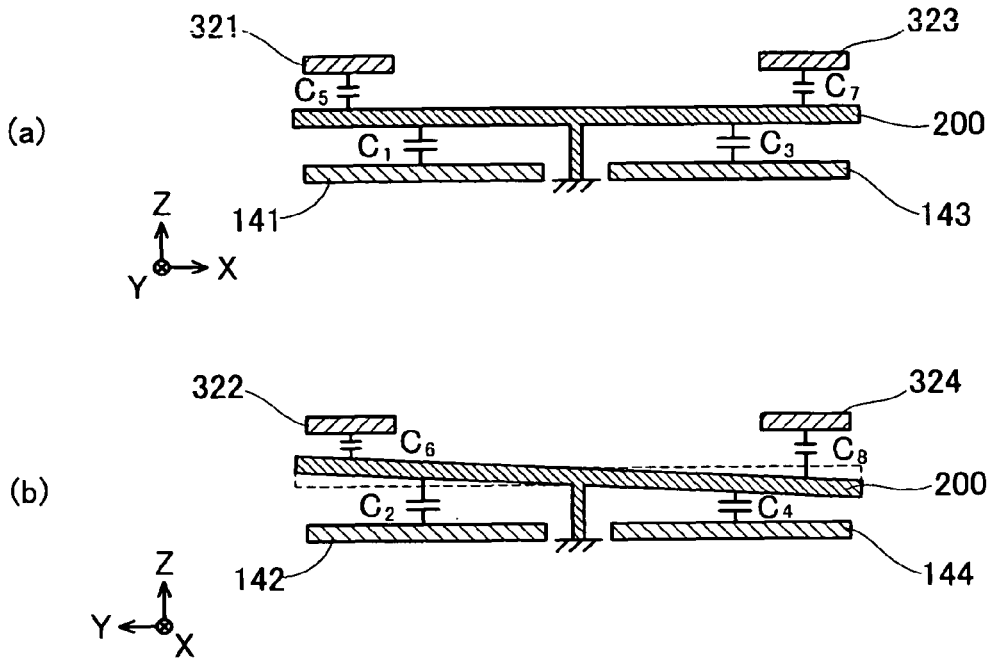
FIG. 4(*a*) is a vertical cross-section view corresponding to line B-B shown in FIG. 1(*a*) when a sound source is in a direction that passes through the center of the diaphragm in a YZ plane, and is tilted at a predetermined angle from a Z axis.

When the sound source is in a direction other than the front of the diaphragm 200, the diaphragm 200 will tilt while vibrating. In this situation, the length of the gaps of all of the first electrode pairs will not increase or decrease in the same phase. Similarly, the length of the gaps of all of the second electrode pairs will not increase or decrease in the same phase. For example, as shown in FIG. 4(*b*), the capacitance of capacitor $C_4$ of the first capacitors will increase when the diaphragm 200 tilts to the right in the drawing. At the same time, the capacitance of capacitor $C_6$ of the second capacitors will increase.

At this point, the capacitance between the first input terminal 502 and the second output terminal 504 of the bridge circuit 501 will be substantially the same value as the capacitance between the first input terminal 502 and the first output terminal 505 thereof. Therefore, no electric potential is produced between the second output terminal 504 and the first output terminal 505. Even when the diaphragm 200 tilts in another direction, the capacitance between the first input terminal 502 and the second output terminal 504 of the bridge circuit 501 will be substantially the same value as the capacitance between the first input terminal 502 and the first output terminal 505 thereof. Therefore, no electric potential is produced between the second output terminal 504 and the first output terminal 505.

In other words, due to the configuration of the bridge circuit 501 described above, a microphone having strong directional characteristics in front of the diaphragm can be achieved.

In the configuration described above, each capacitor that is formed by each electrode pair of the first electrode pairs and the second electrode pairs arranged on both surfaces of the diaphragm will be connected to a bridge circuit. The bridge circuit can detect minute differences in the capacitance of each capacitor. The directional characteristics of the microphone can be improved. In addition, a microphone having strong directional characteristics can be achieved with a simple structure, in which the capacitors formed by the electrode pairs arranged on both sides of a diaphragm are connected to a bridge circuit. This microphone can be achieved with one diaphragm. A microphone having strong directional characteristics in front can be reduced in size. Furthermore, the diaphragm can be constructed so that the portions thereof other than the center portion will not come into contact with other objects, because the diaphragm is supported at its center portion. The periphery of the diaphragm will not receive forces other than acoustic waves. A microphone having strong directional characteristics with respect to the front thereof can be achieved.

Preferably, the first capacitors that are located within a half region of the diaphragm may be connected in series between one input terminal of the bridge circuit and one output terminal of the bridge circuit. On the contrary, the first capacitors that are located within the other half region of the diaphragm may be connected in series between the other input terminal of the bridge circuit and the other output terminal of the bridge circuit. The second capacitors that are located within the other half region of the diaphragm may be connected in series between the one input terminal and the other output terminal. On the contrary, the second capacitors that are located within the half region of the diaphragm may be connected in series between the other input terminal and the one output terminal.

Thus, when the bridge circuit is configured as described above, the electric signal can be output between the two output terminals of the bridge circuit in response to changes in the capacitances of the first capacitors when the capacitances of the first capacitors increase in the same phase.

The bridge circuit has a pair of input terminals (a first input terminal and a second input terminal), and a pair of output terminals (a first output terminal and the second output terminal). Current will flow between the two output terminals when a difference in the electric potentials is produced between the first output terminal and the second output terminal. FIG. 1 and FIG. 7 will be employed to describe the configuration described above.

Here, the capacitors connected between the first input terminal 502 (the one input terminal) and the first output terminal 505 (the one output terminal) will be referred to as the 1-1 capacitors. In the example described above, the capacitors $C_3$ and $C_4$ correspond to the 1-1 capacitors. The 1-1 capacitors amongst the first capacitors are the capacitors that are located within a half region of the diaphragm. In FIG. 1, the half region is the lower right half of the diaphragm 200 divided into two by the line L.

In addition, the capacitors connected between the first input terminal 502 (the one input terminal) and the second output terminal 504 (the other output terminal) will be referred to as the 1-2 capacitors. In FIG. 1, the capacitors $C_5$ and $C_6$ correspond to the 1-2 capacitors. The 1-2 capacitors amongst the second capacitors are the capacitors that are located within the other half region of the diaphragm. The other half region is the upper left half of the region divided into two by the line L in FIG. 1.

In other words, "the half region of the diaphragm" and "the other half region of the diaphragm" mean each of the half two regions of the diaphragm when viewed from the perpendicular direction.

Note that the capacitors $C_1$ and $C_2$ connected between the second input terminal 503 (the other input terminal) and the second output terminal 504 (the other output terminal) are capacitors amongst the first capacitors that are located within the other half region of the diaphragm (the upper left half region of the region in FIG. 1 divided into two by means of the line L).

In addition, the capacitors $C_7$ and $C_8$ connected between the second input terminal 503 (the other input terminal) and the first output terminal 505 (the one output terminal) are capacitors amongst the second capacitors that are located within the half region of the diaphragm (the lower right half region of FIG. 1 divided into two by means of the line L).

The 1-1 capacitors are arranged on the half region on one side of the diaphragm. In contrast, the 1-2 capacitors are arranged on the other half region on the other side of the diaphragm. In other words, the 1-1 capacitors and the 1-2 capacitors are arranged rear surface and front surface respectively, and also arranged in symmetrical positions when the diaphragm is viewed along a direction that is perpendicular to the surfaces thereof. Therefore, when the all portions of the diaphragm vibrate with same phase, the change in the capacitances of the 1-1 capacitors will be in anti-phase with the change in the capacitances of the 1-2 capacitors.

Therefore, the capacitance between the first input terminal and the first output terminal will be different than the capacitance between the first input terminal and the second output terminal. Thus, a difference in the electric potentials will be produced between the first output terminal and the second output terminal. Due to this difference in the electric potentials, current will flow between the two output terminals.

In contrast, the 1-1 capacitors and the 1-2 capacitors are arranged in symmetrical positions. Therefore, if the diaphragm tilts in any direction and vibrates, the capacitances of both groups of capacitors will be equal. In this case, no difference in the electric potentials will be produced between the two output terminals. The same also applies to the other capacitors $C_1$, $C_2$, $C_7$, $C_8$.

In other words, due to the configuration described above, an output from the bridge circuit can only be obtained when the sound source is in front of the diaphragm. A microphone having strong directional characteristics in the front direction can be achieved.

Return to describing technical features of the present invention, the first electrode pairs may be arranged on a circle around the center of the diaphragm at substantially equal intervals. By this arrangement of the first electrode pairs, the difference in the capacitance of the first capacitors will better represent the vibration state of the diaphragm. The direction of the sound source can be identified more accurately.

The second electrode pairs may be arranged on a circle around the center of the diaphragm at substantially equal intervals. In the case where the second capacitors are employed as actuators in order to inhibit vibration of the diaphragm, the actuators can be geometrically arranged with respect to the diaphragm in a simple positional relationship. The displacement of each position on the diaphragm can be easily inhibited.

In addition, in the case where the second capacitors are employed as sensors, the difference in the capacitance of the second capacitors will better represent the vibration state of the diaphragm. The direction of the sound source can be identified more accurately.

In addition, it is preferable that the number of the first electrode pairs is same as the number of the second electrode pairs. In this case, each of the first electrode pairs and corresponding second electrode pair may be aligned when viewed along a direction perpendicular to the diaphragm.

A situation in which one of capacitor group of the first capacitors and the second capacitors is used as sensors, and another capacitor group is used as actuators will be described. In this situation, if each of sensors and corresponding actuator are aligned (lapped over) when the diaphragm is viewed from the perpendicular direction, the position of the diaphragm that determines the quantity of electric energy outputted by the sensor can be made substantially the same as the position of the diaphragm that is controlled by the actuators. A so-called co-location control will be made possible. The co-location control method will be possible to more easily control vibration of the diaphragm.

In addition, a situation in which all of the capacitors of the first capacitors and the second capacitors are used as sensors will be described. In this situation, when each sensor (capacitor) among the first capacitors and corresponding sensor (capacitor) among the second capacitors are aligned (lapped over) when the diaphragm is viewed from the perpendicular direction, the capacitance of the capacitor on one side of the diaphragm will increase with a certain amount while the capacitance of corresponding capacitor on the other side of the diaphragm will decrease with the same amount. In such situation, the bridge circuit can be simply constructed.

The diaphragm may have a substantially circular shape. By making the diaphragm substantially circular shape, the relationship between the direction of the sound source and the amount of displacement of each position on the diaphragm can be simplified. In addition, the relationship between the direction of the sound source and the phase difference of the vibration of each position on the diaphragm can be simplified. A logic circuit that identifies the direction of the sound source can be achieved more simply. Here, "substantially circular" includes, for example, a polygon and an oval.

The center of the diaphragm and a periphery of the diaphragm may be connected with a gimbal. In other words, the diaphragm preferably has a structure in which the center portion thereof and portion thereof other than the center portion are connected by means of a biaxial gimbal structure. "Portion thereof other than the center portion of the diaphragm" may hereinafter be referred to as the "periphery". Due to this configuration, the periphery will be displaced with respect to the center portion via the gimbal. Even if the periphery is constructed with components having high flexural rigidity, vibration of the periphery, due to acoustic waves, in the thickness direction with respect to the center portion can be ensured. By constructing the periphery with components having high flexural rigidity, a higher order vibration mode that will be produced in the periphery when the diaphragm has received acoustic waves can be reduced. The primary mode of the periphery may only be considered when the controller is to identify the direction of the sound source from the phase difference of the changes in the values of electric energy output to each actuator over time. Identification of the direction of the sound source will be simplified.

The concept of the present invention is to control the displacement of the diaphragm in the thickness direction so that the value of electric energy output from a sensor in response to the displacement of the diaphragm maintains a constant value. This does not mean that the value of electric energy output from the sensor in response to the displacement of the diaphragm in the thickness direction is limited by the capacitance. In other words, the sensor output a value of electric energy in response to the displacement of the diaphragm is not limited to capacitor. In addition, this is not limited to the electrode pairs that serve as actuators that generate electrostatic attraction force in order to inhibit vibration of the diaphragm. Therefore, the microphone according to the present invention can be formed as follows. A microphone comprises a diaphragm, sensors, actuators, and a controller. Here, the diaphragm is supported at the center thereof, and which vibrates when the diaphragm receives acoustic waves. The sensors are distributed around the center of the diaphragm for detecting displacements of the diaphragm at the distributed positions. The actuators are distributed around the center of the diaphragm for canceling the detected displacements. The controller identifies a direction along which the acoustic wave propagates based on values of electric energies applied to the actuators for canceling the displacements of the diaphragm during vibration.

Here, piezoelectric elements or piezoresistors can be employed, for example, as the sensors that output electric signal in response to the displacement of the diaphragm in the thickness direction. In addition, optical displacement sensors may be used. Furthermore, piezoelectric elements can be employed as the actuators that control the detected displacements of the diaphragm in the thickness direction. Moreover, actuators generating magnetic force may be employed.

Due to the configuration described above, a microphone can be achieved that can inhibit vibration of a diaphragm in which the center portion thereof is supported while identifying the direction of the sound source. In other words, the direction of the sound source can be identified from the differences in the values of electric energies output to the actuators that control the displacements of the diaphragm in the thickness direction, so as to maintain the value of electric signal from each sensor to a constant value.

With a microphone having particularly strong directional characteristics in front direction thereof, capacitors will be formed by each of the first electrode pairs and the second electrode pairs arranged on both surfaces of the diaphragm. A microphone having strong directional characteristics in the front direction can be achieved by means of a bridge circuit that uses capacitors. Achieving a microphone having strong directional characteristics in the front direction according to the present invention is not limited to using capacitors. Piezoelectric elements or piezoresistors can be employed as devices that output a value of electric energy in response to the displacement of a diaphragm. Alternatively, optical displacement sensors may be used. Even if these sensors are employed, a microphone having strong directional characteristics in the front direction thereof can be achieved in the same way. This means that the microphone of the present invention can also be constructed as follows. A microphone comprises a diaphragm, first sensors, second sensors, and a bridge circuit. Here, the diaphragm is supported at the center thereof, and which vibrates with acoustic waves. The first sensors are distributed on one side of the diaphragm around the center of the diaphragm. Each first sensor outputs electric signal corresponding to a displacement of the diaphragm at a position facing the first sensor. The second sensors are distributed on the other side of the diaphragm around the center of the diaphragm. Each second sensor outputs electric signal corresponding to a displacement of the diaphragm at a position facing the second sensor. The bridge circuit electrically connects the first sensors and the second sensors, wherein the bridge circuit is formed so as to output electric signal corresponding to the electric signal outputted from at least one of the first sensors when values of the electric signals outputted from the first sensors have a predetermined relationship.

When the diaphragm receives acoustic waves which propagate along the front direction of the diaphragm, positions of the diaphragm that distribute around the center portion thereof will vibrate with the same phase. In this case, the relationship between the timing of the increase and decrease in the value of electric signal that each of the first sensors outputs is also predetermined in association with the vibration of each position on the diaphragm that distributes around the center portion thereof. This relationship can be determined in advance. A electric signal corresponding to the value of electric signal that at least one sensor outputs will be output from the bridge circuit to an device, when the timing of the increase and decrease in the value of electric signal that each of the first sensors outputs is in a predetermined relationship. Here, the "timing of the increase and decrease" means relative timing of the output electric signals of the first sensors each other.

Due to the configuration described above, a microphone having strong directional characteristics in front direction of the diaphragm can be achieved.

The predetermined relationship described above is preferably a relationship in which the values of electric signals outputted from the first sensors have substantially the same phase. When the diaphragm receives acoustic waves from the front direction thereof, the values of electric signals output by the first sensors that are arranged on one side of the diaphragm will increase and decrease in the same phase. By using this relationship, the bridge circuit can be constructed in a simple shape.

The manufacturing method of the microphone according to the present invention preferably includes a step of forming a second sacrifice layer, a step of forming a backplate layer, and step of removing the second sacrifice layer. In this case, the semiconductor layer may be formed so as to leave an outer portion of the sacrifice layer exposed. In the step of forming the second sacrifice layer, the second sacrifice layer that covers from the surface of the outer portion of the semiconductor substrate to the surface of the semiconductor layer is formed. In the step of forming the backplate layer, the backplate that covers from the surface of the semiconductor substrate surrounding the sacrifice layer to a position on the second sacrifice layer is formed. Here, the position faces at least a periphery of the semiconductor layer. In the step of removing the second sacrifice layer, the second sacrifice layer is removed by etching.

By forming backplate layer, backplate that extends to a position facing at least the surface of the periphery of the semiconductor layer (the semiconductor layer will become the diaphragm when the microphone is manufactured) when viewed from above can be formed. By removing the second sacrifice layer that is formed between the backplate layer and the semiconductor layer, the semiconductor layer which does not come into contact with the backplate layer can be realized. A diaphragm in which the periphery thereof is capable of being freely vibrated in the thickness direction can be formed. By providing electrodes on the front and rear surfaces of the diaphragm, and providing electrodes on the surface of the backplate opposite the diaphragm, a microphone having facing electrode pairs on the front and rear surfaces of the diaphragm can be manufactured.

Embodiment 1

FIG. 1 depicts the general concept of a microphone 100 as the first embodiment. FIG. 1(*a*) is a plan view of the microphone 100. FIG. 1(*b*) is a vertical cross-section view corresponding to line B-B shown in FIG. 1(*a*). FIG. 1(*c*) is a vertical cross-section view corresponding to line C-C shown in FIG. 1(*a*).

The microphone 100 comprises a circular diaphragm 200. The diaphragm 200 is supported to the frame 102 of the microphone 100 at a center portion 201 of the diaphragm 200.

Four upper electrodes 321, 322, 323, 324 are arranged to a member (not shown) that is fixed to the frame 102. The four upper electrodes 321, 322, 323, 324 are positioned facing the front surface of the diaphragm 200 (the surface that receives acoustic waves). The four upper electrodes 321, 322, 323, 324 will be collectively referred to as upper electrodes 320. The upper electrodes 320 are arranged at equal intervals in the circumferential direction of the circular diaphragm 200. Each of the upper electrodes 320 is formed in an arcuate shape having a predetermined width. Third electrodes (not shown in the drawings) are arranged on the front surface of the diaphragm 200 at positions distributed around the center portion 201. Each of the third electrodes faces corresponding electrode of the upper electrodes 320. A gap of predetermined length is formed between each of the upper electrodes 320 and corresponding third electrode. The upper electrodes 320 may be referred to as fourth electrodes. Each of the fourth electrodes (i.e., the upper electrodes 320) and corresponding third electrode form a second electrode pair.

Four lower electrodes 141, 142, 143, 144 are arranged to a member (not shown) that is fixed to the frame 102. The four lower electrodes 141, 142, 143, 144 are positioned facing the rear surface of the diaphragm 200 (the surface that is opposite the surface that receives acoustic waves). The four lower electrodes 141, 142, 143, 144 will be collectively referred to as lower electrodes 140. The lower electrodes 140 are arranged at equal intervals in the circumferential direction of the circular diaphragm 200. Each of the lower electrodes 140 is formed in a fan shape. First electrodes (not shown in the drawings) are arranged on the rear surface of the diaphragm 200 at positions distributed around the center portion 201. Each of the first electrodes faces corresponding electrode of the lower electrodes 140. A gap of predetermined length is formed between each of the lower electrodes 140 and corresponding first electrode. The lower electrodes 140 may be referred to as second electrodes. Each of the second electrodes (i.e., the lower electrodes 140) and corresponding first electrode form a first electrode pair.

A constant voltage is applied between each of the lower electrodes 140 (i.e., the second electrodes) and the first electrode facing thereto. Thus, four capacitors are formed by the first electrode pairs. Each capacitor that is formed by each of the first electrode pairs will be represented by the following reference symbol respectively. The capacitor that is formed by means of the lower electrode 141 (one of the second electrodes) and the first electrode arranged on the diaphragm 200 facing the lower electrode 141 is represented by $C_1$. The capacitor that is formed by means of the lower electrode 142 and the first electrode arranged on the diaphragm 200 facing the lower electrode 142 is represented by $C_2$. The capacitor that is formed by means of the lower electrode 143 and the first electrode arranged on the diaphragm 200 facing the lower electrode 143 is represented by $C_3$. The capacitor that is formed by means of the lower electrode 144 and the first electrode arranged on the diaphragm 200 facing the lower electrode 144 is represented by $C_4$. The four capacitors that are formed by means of each electrode of the lower electrode 140 and corresponding first electrode will be hereinafter collectively referred to as the lower capacitors (or the first capacitors).

Four capacitors are formed by means of each electrode of the upper electrodes 320 and corresponding third electrode arranged on the diaphragm 200. These capacitors will be hereinafter referred to as the upper capacitors (or second electrodes).

When the diaphragm 200 receives acoustic waves, each position on the diaphragm 200 will be displaced. The diaphragm 200 is supported by the frame 102 only at the center portion 201 of the diaphragm 200. Thus, each position of the diaphragm 200 will be displaced over time with a certain phase depending on the direction in which the acoustic waves propagate (i.e., the direction of the sound source).

When each position of the diaphragm 200 is displaced, the length of the gap between each of the lower electrodes 140 and corresponding first electrode arranged on the diaphragm will change. Each first electrode pair (a pair of each of the lower electrodes 140 and corresponding first electrode) form the lower capacitor (first capacitor). The capacitance of each lower capacitor will also change in response to the change in the length of the gap between each first electrode pair.

Forming each of the upper electrodes 320 in an arcuate shape of predetermined width serves to open the upper surface of the diaphragm 200, the upper surface receiving the acoustic waves, so as to be as wide as possible. In contrast, because each of the lower electrodes 140 are not on the side of the diaphragm 200, the side receiving acoustic waves, the surface region of these electrodes are arranged to be as wide as possible. When the surface region of each of the lower electrodes 140 is wide, the amount of change in the capacitance of the lower capacitors can be increased in response to the changes in the lengths of the gaps between each of the first electrode pair.

Figure 2:
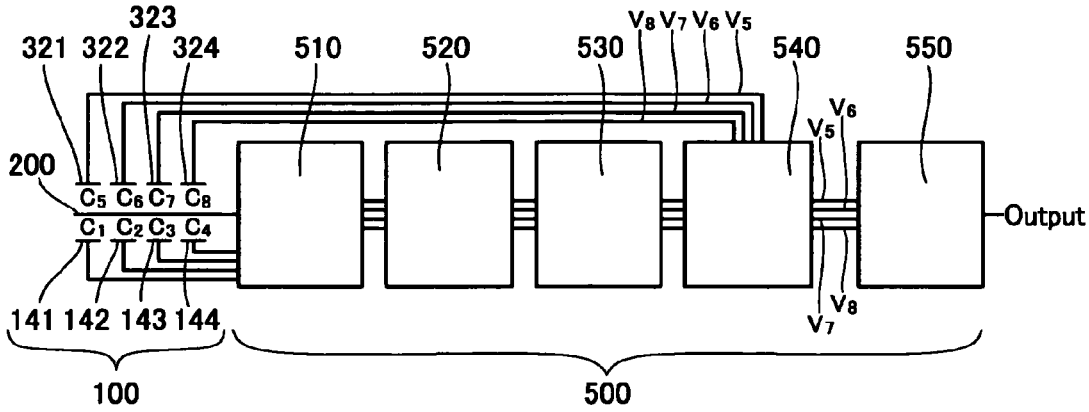
FIG. 2 is a block diagram of a controller that identifies the direction of the sound source.

Next, a controller 500 that identifies the direction of the sound source will be described by means of FIG. 2. FIG. 2 is a block diagram of the controller 500. In addition, the connection relationship between the controller 500 and each capacitor of the microphone 100 is schematically depicted in FIG. 2. Illustration of each electrode arranged on the diaphragm 200 is omitted in FIG. 2. Each electrode arranged on the diaphragm 200 is illustrated simply as diaphragm 200.

The controller 500 comprises a detection circuit 510, a sample hold circuit 520, an amplification circuit 530, a root circuit 540, and a sound source direction identification circuit 550.

The detection circuit 510 applies a constant voltage to each lower capacitor (capacitor $C_1$, $C_2$, $C_3$, and $C_4$). The detection circuit 510 simultaneously detects the capacitance of each lower capacitor. In other words, a circuit that measures the capacitance of each capacitor $C_1$, $C_2$, $C_3$, $C_4$ is included in the detection circuit 510.

When the diaphragm 200 receives acoustic waves and vibrates, the length of the gap of each capacitor will change. The capacitance of each lower capacitor will change. Even though a constant voltage is applied to each lower capacitor, if the capacitance of each lower capacitor changes, an electric current will flow that corresponds to this change. The detection circuit 510 can detect the capacitance of each lower capacitor $C_1$, $C_2$, $C_3$, $C_4$ from the change in electric current.

A current value will be input into the sample hold circuit 520 in response to the capacitance of each lower capacitor $C_1$, $C_2$, $C_3$, $C_4$ detected. The sample hold circuit 520 will hold the current value input for each predetermined period of time (more specifically, each control cycle) and output the same to the amplification circuit 530.

The amplification circuit 530 will amplify the DC current output by the sample hold circuit 520 with a predetermined gain and output the same to the root circuit 540.

The current value amplified in accordance with the change in the capacitance of each lower capacitor will be input to the root circuit 540. The root circuit 540 will apply a voltage to each of the upper capacitors $C_5$, $C_6$, $C_7$, $C_8$ respectively based upon this current value, so that the capacitance of each of the lower capacitors will be held at constant value. Here, "constant value" is preferably the initial value of capacitance of each lower capacitor. In other words, it is preferable that a voltage is applied to each of the upper capacitors so that the amount of change in the capacitance of each lower capacitor will be zero.

More specifically, the root circuit 540 will output an appropriate voltage ($V_5$, $V_6$, $V_7$, $V_8$ shown in FIG. 2) to each of the upper capacitors $C_5$, $C_6$, $C_7$, $C_8$ respectively in response to each current value input to the root circuit 540, wherein each current value corresponds to the change of corresponding lower capacitor. The value of each voltage $V_5$, $V_6$, $V_7$, $V_8$ will be determined from the positional relationship between the first electrode pairs that form the lower capacitors $C_1$, $C_2$, $C_3$, $C_4$ and the second electrode pairs that form the upper capacitors $C_5$, $C_6$, $C_7$, $C_8$, and the relationship between the voltage that is applied to the each upper capacitor and the attraction force that the upper capacitor generates. In other words, a feedback circuit that keeps the capacitance of each lower capacitor at a constant value is formed by the detection circuit 510, the sample hold circuit 520, the amplification circuit 530, and the root circuit 540.

This means that control is performed such that the diaphragm 200 is maintained in the state that it is in when not vibrating. The diaphragm 200 may deform from its initial shape due to fatigue when it is vibrated for a long period of time. When the diaphragm 200 deforms from its initial shape, accuracy on identifying the direction of the sound source will decline. By maintaining the diaphragm 200 in the state that it is in when not vibrating while the diaphragm 200 receives acoustic waves, deformation due to fatigue can be inhibited.

The voltage values ($V_5$, $V_6$, $V_7$, $V_8$) that the root circuit 540 outputs to the upper capacitors $C_5$, $C_6$, $C_7$, $C_8$ will be input to the sound source direction identification circuit 550. When the diaphragm 200 vibrates, the length of the gap between each first electrode pair that forms each lower capacitor will change periodically in response to the vibration. The lengths of the gaps will change with different in phases each other, depending on the direction of the sound source. Therefore, the capacitances of the lower capacitors will also change with difference in phases, depending on the direction of the sound source. The voltage values ($V_5$, $V_6$, $V_7$, $V_8$) that are applied to the upper capacitors respectively will also change with difference in phases over time depending on the direction of the sound source, so that the capacitance of each of the lower capacitors will be held at constant value. There is a predetermined relationship between the direction of the sound source and the phase difference of the vibration of each portion of the diaphragm. As a result, there is a relationship between the direction of the sound source and the phase difference among the voltage values ($V_5$, $V_6$, $V_7$, $V_8$). The relationship between the direction and the phase difference can be predetermined. The sound source direction identification circuit 550 will identify the direction of the sound source from the phase difference of the voltage values ($V_5$, $V_6$, $V_7$, $V_8$) applied to the upper capacitors respectively based upon this predetermined relationship. The sound source direction identification circuit 550 will output electric signal that indicates the direction of the sound source.

Here, a description of the control of the root circuit 540 will be provided. The root circuit 540 will apply a voltage to each of the upper capacitors so that the capacitance of each of the lower capacitors will be held at constant value.

The control logic of the root circuit 540 can be simplified by the structure of the microphone 100 shown in FIG. 1. Each of the upper electrodes 320 is arranged in respective regions in which the circular diaphragm 200 is divided into four fan shapes. Each of the lower electrodes 140 is also arranged in each region divided into four fan shapes. The number of lower electrode pairs (first electrode pairs) that form the lower capacitors (the first capacitors) is equal to the number of upper electrode pairs (second electrode pairs) that form the upper capacitors (the second capacitors). Thus, when the diaphragm is viewed from the direction perpendicular to the diaphragm 200, the position at which each of the first electrode pairs is arranged is substantially the same as the position at which uniquely corresponding second electrode pair is arranged. In other words, each of the lower capacitors that function as sensors and uniquely corresponding upper capacitor that functions as actuator are arranged in substantially the same positions when the diaphragm is viewed from the perpendicular direction. Due to this arrangement, co-location (a state in which each of the sensors and corresponding actuator are arranged in substantially the same positions of a controlled object) will be achieved. Thus, for example, the voltage applied to the upper electrode 321 may be controlled while the capacitance of the capacitor formed by the lower electrode 141 on the same fan shaped regions is being controlled. And, for example, the voltage applied to the upper electrode 322 may be controlled while the capacitance of the capacitor formed by the lower electrode 142 on the same fan shaped regions is being controlled. The same is true for the lower electrodes 143, 144. The capacitance of the first capacitors can be independently controlled. The control circuit can be simplified.

In addition, if co-location is achieved, the following effects can be obtained. If each of first capacitors (the first capacitors serve as sensors) and corresponding second capacitor (the second capacitors serve as actuators) are aligned when viewed along the direction perpendicular to the diaphragm 200, the force output by the second capacitor (the actuator) for suppressing vibration is substantially equal to the force received by the diaphragm 200 from the acoustic waves at position on which the first capacitor corresponding to the second capacitor is arranged. The conventional method will detect the amount of displacement of each position on the diaphragm due to acoustic waves by means of sensors. The direction of the sound source will be identified from the difference in the amount of displacement of the diaphragm at each sensor position. In other words, in the conventional method, the signals from the sensors are input to a logic circuit and the logic circuit identifies the direction of the sound source based on the input signals. According to the present method, the direction of the sound source can be identified by simply replacing the input signals with the signals that the controller outputs to each actuator. A conventional circuit can be used to achieve most of the logic circuit that identifies the direction of the sound source.

Figure 3:
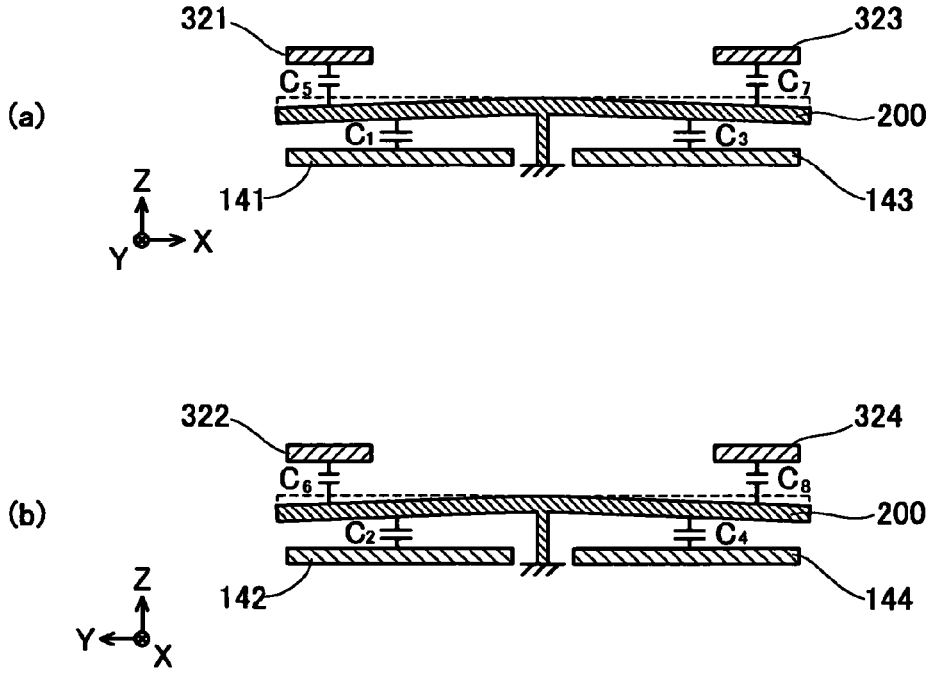
FIG. 3(*a*) is a vertical cross-section view corresponding to line B-B shown in FIG. 1(*a*) when a sound source is in a Z direction.
Figure 5:
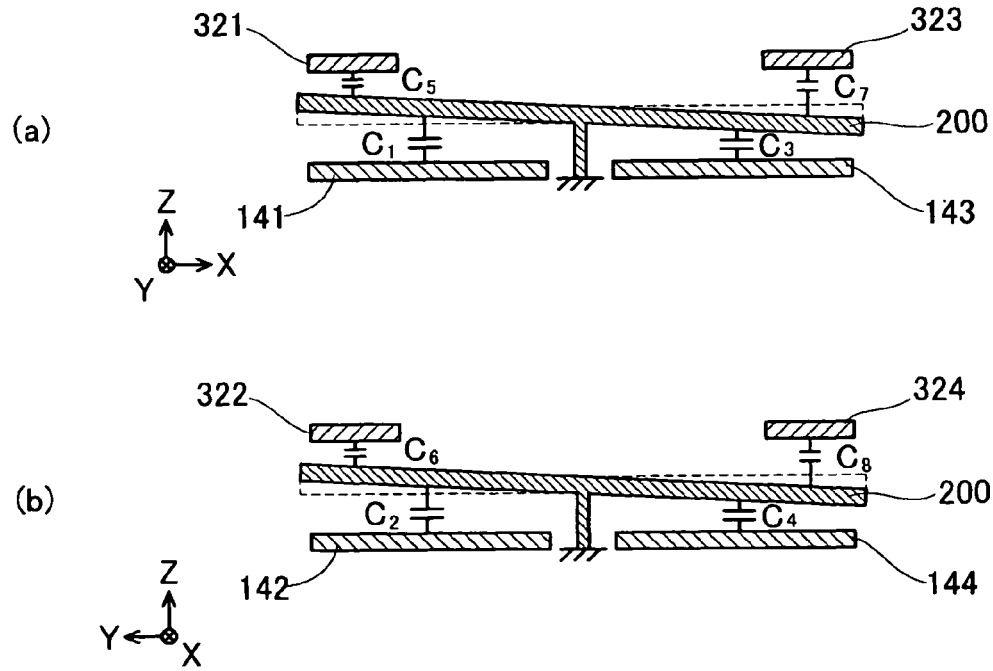
FIG. 5(*a*) is a vertical cross-section view corresponding to line B-B shown in FIG. 1(*a*) when a sound source is in a direction that passes through the center of the diaphragm in a plane in which the XZ plane is rotated 45 degrees around the Z axis, and is tilted at a predetermined angle from a Z axis.

Next, FIGS. 3 to 5 will be employed in order to depict a specific example that will identify the direction of the sound source. FIG. 3 shows the displacement of the diaphragm 200 when there is a sound source in the front direction (the Z direction) of the diaphragm 200. FIG. 3(*a*) is a vertical cross-section view corresponding to line B-B of FIG. 1(*a*). FIG. 3(*b*) is a vertical cross-section view corresponding to line C-C of FIG. 1(*a*).

When the sound source is in the Z direction, the diaphragm 200 will be symmetrically displaced around the center portion 201. In other words, the diaphragm 200 will be symmetrically bent in the vertical direction around the center portion 201. When the diaphragm 200 vibrates, the diaphragm 200 will bent toward the lower electrodes 140 as shown in FIG. 3 periodically. At the timing when the diaphragm 200 will bent toward the lower electrodes 140, the length of the gaps of the first capacitors $C_1$, $C_2$, $C_3$, $C_4$ will shorten simultaneously. Thus, the capacitances of the lower capacitors $C_1$, $C_2$, $C_3$, $C_4$ will increase together. The controller 500 will apply a voltage to each second capacitor $C_5$, $C_6$, $C_7$, $C_8$ so as to cancel the increase in the capacitances of the first capacitors. At this point, the voltages applied to the second capacitors respectively will change over time with the same phase. Because the voltages applied to the second capacitors will change over time with the same phase when the direction of the sound source is the Z direction, the direction of the sound source can be identified.

FIG. 4 depicts the displacement of the diaphragm 200 when the sound source is in a direction that passes through the center of the diaphragm within the YZ plane. FIG. 4(*a*) is a vertical cross-section view corresponding to line B-B of FIG. 1(*a*). FIG. 4(*b*) is a vertical cross-section view corresponding to line C-C of FIG. 1(*a*).

When the sound source is in a direction that passes through the center of the diaphragm in the YZ plane, and is tilted from the Z axis by a certain angle, the diaphragm 200 will tilt around the X axis. In this case, the capacitance of the lower capacitor $C_4$ will increase while the capacitance of the lower capacitor $C_2$ will decrease. The capacitance of the lower capacitors $C_1$ and $C_3$ will not change. The controller 500 will apply voltages to the upper capacitors $C_6$ and $C_8$ so as to cancel the change in the capacitance of the lower capacitors $C_2$ and $C_4$. When the sound source is in a direction that passes through the center of the diaphragm in the YZ plane, and is tilted from the Z axis by a certain angle, the direction of the sound source can be identified from the phase difference of the voltages applied.

FIG. 5 depicts the displacement of the diaphragm 200 when a sound source is in a direction that passes through the center of the diaphragm in a plane in which the XZ plane is rotated 45 degrees around the Z axis, and tilted at a predetermined angle from the Z axis. FIG. 5(*a*) is a vertical cross-section view corresponding to line B-B of FIG. 1(*a*). FIG. 5(*b*) is a vertical cross-section view corresponding to line C-C of FIG. 1(*a*).

In this situation, the diaphragm 200 is tilted in a plane in which the XZ plane was rotated 45 degrees around the Z axis. In this case, the capacitances of the lower capacitors $C_3$ and $C_4$ will increase while the capacitances of the lower capacitors $C_1$ and $C_2$ will decrease. The controller 500 will apply voltages to the upper capacitors $C_5$, $C_6$, $C_7$, and $C_8$ respectively so as to cancel the change in the capacitances of lower capacitor. When the sound source is in a direction that passes through the center of the diaphragm in a plane in which the XZ plane is rotated 45 degrees around the Z axis, and tilted at a certain angle from the Z axis, the direction of the sound source can be identified from the phase difference of the voltages supplied to the upper capacitors $C_5$, $C_6$, $C_7$, and $C_8$ respectively.

The examples from FIG. 3 to FIG. 5 have simply described the process of identifying the direction of the sound source. The direction of the sound source can be identified with better accuracy by more precisely calculation based on the phase differences of the voltages applied to the upper capacitors by the controller 500.

In the embodiment described above, the first electrode pairs and the second electrode pairs that form the capacitors are comprised of four pairs each. There may be two or more pairs of the first electrode pairs and the second electrode pairs that form the capacitors.

For example, when each of the two first electrode pairs are arranged on the left and right of the center portion of the diaphragm, and each of the two second electrodes pair is also arranged on the left and right thereof, the direction of the sound source will be identified when it is in the front of the microphone, to the left of the microphone, or to the right of the microphone. If the sound source is on the right side, the displacement of the right side of the diaphragm will be larger than the displacement of the left side thereof. The change in the capacitance of the capacitor on the right side formed by the right side first electrode pair will also be larger than the change in the capacitance of the capacitor on the left side formed by the left side first electrode pair. In order to make the capacitances of the capacitors on the left and right side formed by the first two electrode pairs have a constant value (preferably the initial value), the voltage output to the capacitor on the right side formed by the right side second electrode pair will be larger than the voltage output to the capacitor on the left side formed by the left side second electrode pair. When the voltage output to the capacitor on the right side is larger than the voltage output to the capacitor on the left side, the direction of the sound source will be identified as being to the right. If the sound source is in front of the microphone, the change in the capacitances of the capacitors on the left and right side formed by the two first electrode pairs will be equal. The values of the voltages applied to the capacitors on the left and right side that are formed by the two second electrode pairs will also be equal. When the values of the voltages output to the capacitors on the left and right side are equal, the sound source can be identified as being in the front direction.

If three or more pairs of the first electrode pairs and the second electrode pairs are arranged, the direction of the sound source can be identified three dimensionally on the front of the microphone.

In the present embodiment, the first electrode pairs, each of which is comprises the first electrode and the second electrode, are arranged on one side of the diaphragm. The first electrodes of the first electrode pairs are arranged on one surface of the diaphragm. In addition, the second electrode pairs, each of which is comprises the third electrode and the fourth electrode, are arranged on the other side of the diaphragm. The third electrodes of the second electrode pairs are arranged on the other surface of the diaphragm. Each of the first electrode pairs and each of the second electrode pairs together form the capacitors. The capacitors formed by the first electrode pairs are used as sensors that output electric energy that correspond to the displacement of the portions of diaphragm, the portions at which the sensors being arranged. Here, the electric energy is the capacitance. In addition, the capacitors formed by the second electrode pairs are used as actuators that control the displacement of the diaphragm. The force generated by the second electrode pairs is electrostatic attraction force.

One of the electrodes of the first electrode pairs and one of the electrodes of the second electrode pairs are arranged on the diaphragm, the other electrode are arranged across a predetermined gap length, and the capacitors formed thereby can place both electrodes in a non-contact state. Thus, the diaphragm can keep the portions thereof other than the center portion in a non-contact state. Other than the force caused by the acoustic waves and the force caused by the actuators, the diaphragm will be kept in a state in which an external force is not applied thereto. The direction of the sound source can be identified more accurately.

In addition, in the present embodiment, the first electrode pairs are arranged on a circle around the center portion of the diaphragm with substantially equal intervals. By such arrangement of the first electrode pairs, the relationship between the direction of the sound source and the phase difference in the change of the capacitance of the capacitors formed by the first electrode pairs in each position of the diaphragm can be simplified. The logic circuit for maintaining the displacement of each position of the diaphragm in constant can be simplified.

In addition, the second electrode pairs that are used as actuators are also arranged on a circle around the center portion of the diaphragm with substantially equal intervals. By such arrangement of the second electrode pairs, a plurality of actuators can be arranged in a simple geometric relationship with respect to the diaphragm. Vibration of the diaphragm can be more easily suppressed.

In the present embodiment, the direction of the sound source may be identified from the phase difference of voltages output respectively by the controller to the second capacitors formed by the second electrode pairs. The direction of the sound source can also be identified from the difference in the voltage values output respectively by the controller to the second capacitors formed by the second electrode pairs. For example, when the voltage value output to a certain capacitor is always higher than the voltage value output to other capacitors, the direction of the sound source can be identified as the direction in which the a certain capacitor is located. In this case, the logic that identifies the direction of the sound source can be simplified.

In the present embodiment, the first electrode pairs, each of which is comprises the first electrode and the second electrode, are arranged on one side of the diaphragm. The first electrodes of the first electrode pairs are arranged on one surface of the diaphragm. In addition, the second electrode pairs, each of which is comprises the third electrode and the fourth electrode, are arranged on the other side of the diaphragm. The third electrodes of the second electrode pairs are arranged on the other surface of the diaphragm. Each of the first electrode pairs and each of the second electrode pairs together form the capacitors. The capacitors formed by the first electrode pairs are used as sensors that output electric energy that correspond to the displacement of the portions of diaphragm, the portions at which the sensors being arranged. Here, the electric energy is the capacitance. In addition, the capacitors formed by the second electrode pairs are used as actuators that control the displacement of the diaphragm. The force generated by the second electrode pairs is electrostatic attraction force.

According to the concept of the present invention, any device that outputs a signal in response to the displacement of the diaphragm can be employed instead of the first electrode pairs. In addition, any device that controls the displacement of the diaphragm can be used instead of the second electrode pairs. Piezoelectric elements or piezoresistors can, for example, be employed as sensors that output a signal in response to the displacement of the diaphragm. In addition, optical displacement sensors can also be used. Furthermore, piezoelectric elements or piezoresistors can, for example, be employed as actuators that control the displacement of the diaphragm. Moreover, actuators that use magnetic force may be employed.

This means that the present invention can be described in another way as follows. A microphone comprises a diaphragm, sensors, actuators, and a controller. Here, the diaphragm is supported at the center thereof, and which vibrates when the diaphragm receives acoustic waves. The sensors are distributed around the center of the diaphragm for detecting displacements of the diaphragm at the distributed positions. The actuators are distributed around the center of the diaphragm for canceling the detected displacements. The controller identifies a direction along which the acoustic wave propagates based on values of electric energies applied to the actuators for canceling the displacements. According to the microphone described above, the same effects as the embodiment can be obtained.

Note that the electrode pairs are formed by each electrode of the lower electrodes 140 and electrode arranged on the rear surface of the diaphragm and facing the corresponding lower electrode. Each of this electrode pairs forms a capacitor which serves as a sensor. This electrode pairs correspond to the first electrode pairs. The capacitors formed by the first electrode pairs correspond to the first capacitors. In addition, the electrode pairs are formed by each electrode of the upper electrodes 320 and electrode arranged on the front surface of the diaphragm and facing the corresponding upper electrode. Each of this electrode pairs forms a capacitor which serves as an actuator. This electrode pairs correspond to the second electrode pairs. The capacitors formed by the second electrode pairs correspond to the second capacitors. In addition, the controller preferably applies a predetermined electric energy (voltage) between each first electrode pair, applies a electric energy (voltage) to each second electrode pair so that each capacitance in each first capacitance is held at a constant value, and identifies the direction of the sound source from the difference in the amount of electric energies applied to the second electrode pairs respectively.

In the present embodiment, plurality of electrodes, each of the electrodes faces corresponding upper electrode respectively, are arranged on the diaphragm 200. Similarly, plurality of other electrodes, each of the other electrodes faces corresponding lower electrode respectively, are also arranged on the diaphragm 200. One common electrode may be arranged on the diaphragm 200 instead of the plurality of electrodes. Similarly, another common electrode may be arranged on the diaphragm 200 instead of the plurality of other electrodes. Furthermore, the one common electrode and another common electrode may be identical. This is because it will be possible to individually measure the capacitance between each electrode pair, even if one electrode of the plurality of electrode pairs that form the capacitors is a common electrode. In this situation, the electrodes that are made common are preferably electrically grounded.

Embodiment 2

Figure 6:
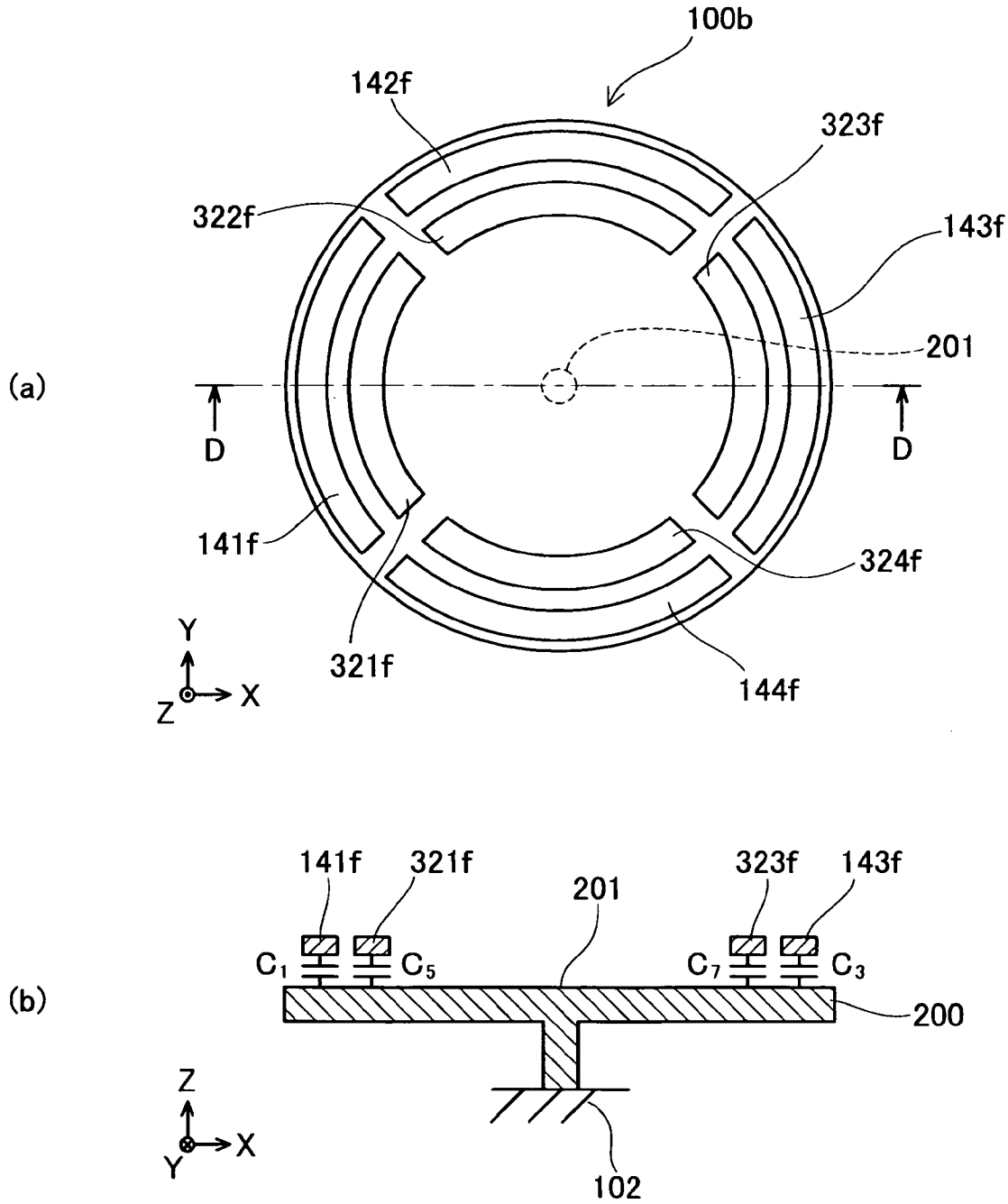
FIG. 6(*a*) is a plan view of a microphone of the second embodiment.

Next, the second embodiment of the present invention will be described in detail below with reference to the drawings. FIG. 6 shows the microphone 100*b* in this embodiment. In this embodiment, capacitors serving as sensors and capacitors serving as actuators are arranged on the same surface of the diaphragm (the front surface which receives acoustic waves).

FIG. 6(*a*) is a plan view of a microphone 100*b*. FIG. 6(*b*) is a vertical cross-section view corresponding to line D-D of FIG. 6(*a*).

Microphone 100*b* comprises a circular diaphragm 200 that is identical to the first embodiment. The diaphragm 200 is supported by the frame 102 of the microphone 100*b* at a center portion 201 of the diaphragm 200.

Four second electrodes 141*f*, 142*f*, 143*f*, 144*f* are arranged facing the front surface of the diaphragm 200. The four second electrodes 141*f*, 142*f*, 143*f*, 144*f* may be collectively referred to as the second electrodes 140*f*. Each of the second electrodes 140*f* is formed in an arcuate shape having a predetermined width. The second electrodes 140*f* are arranged on a circle around the center of the diaphragm 200 with substantially equal intervals. First electrodes (not shown in the drawings) are arranged on the front surface of the diaphragm 200. Each of the first electrodes faces corresponding fourth electrode. A gap of predetermined length is formed between each first electrode and corresponding second electrode. Each first electrode and corresponding second electrode form a first electrode pair. Each first electrode pair forms a first capacitor.

Four fourth electrodes 321*f*, 322*f*, 323*f*, 324*f* are arranged facing the front surface of the diaphragm 200 (the surface that receives acoustic waves). The four fourth electrodes 321*f*, 322*f*, 323*f*, 324*f* may be collectively referred to as the fourth electrodes 320*f*. The fourth electrodes 320 are arranged inside the second electrodes 140*f*. Each of the fourth electrodes 320*f* is formed in an arcuate shape having a predetermined width. The fourth electrodes 320*f* are arranged on a circle around the center of the diaphragm 200 with substantially equal intervals. Third electrodes (not shown in the drawings) are arranged on the front surface of the diaphragm 200. Each of the third electrodes faces corresponding fourth electrode. A gap of predetermined length is formed between each third electrode and corresponding fourth electrode. Each third electrode and corresponding fourth electrode form a second electrode pair. Each second electrode pair forms a second capacitor.

The first capacitors formed by the first electrode pairs serve as sensors that output signals in response to the displacement of each position on the diaphragm 200 in the same way as the first embodiment.

The second capacitors formed by the second electrode pairs serve as actuators that generate force for suppressing the displacement of each position on the diaphragm 200 in the same way as the first embodiment.

Because the controller that controls the microphone 100*b* may be the same structure as the controller 500 of the first embodiment, a description thereof will be omitted. The method of identifying the sound source by means of the controller 500 is also the same as that of the first embodiment.

In the embodiment 2, the plurality of sensors and the plurality of actuators are arranged together on the same surface of the diaphragm. Because of this structure, the microphone 100*b* can be made thinner.

Embodiment 3

Next, embodiment 3 will be described. The diaphragm of a microphone will sometimes vary from the design thereof due to manufacturing errors or changes thereto over time. When the diaphragm varies from the design thereof, accuracy on identifying the direction of the sound source will decline. Here, the design of the diaphragm is, for example, the shape of the diaphragm and the tilt of the diaphragm with respect to the supported center portion thereof. The embodiment 3 will provide a microphone that can keep the diaphragm in its originally designed state. Therefore, the accuracy on identifying the direction of the sound source will not decline.

The structure of the microphone of the embodiment 3 may be the same as the structure of the microphone 100 of the first embodiment. The structure of the controller may also be the same as the structure of the controller 500. Thus, FIGS. 1 and 2 will be employed to describe the microphone of the embodiment 3.

When the shape of the diaphragm or the tilt of the diaphragm with respect to the supported center portion thereof varies from design, the capacitance of the capacitors (the capacitors $C_1$ to $C_4$, see FIG. 1) will vary from the capacitance originally designed. In the embodiment 3, the following process will be performed by the controller 500 of the first embodiment prior to identifying the direction of the sound source.

The capacitance of each of the lower capacitors will be measured by the detection circuit 510 when the diaphragm is not receiving acoustic waves.

Predetermined voltages will be applied to the upper capacitors respectively so that the measured capacitance of each lower capacitor matches the capacitance originally designed. The quantity of displacement at each position of the diaphragm can be corrected by means of the electrostatic attraction force generated by each of the upper capacitors due to applied predetermined voltages. Thus, the capacitance of each of the lower capacitors can always match the capacitance originally designed. The root circuit 540 will store the predetermined voltages applied to the upper capacitors respectively as bias voltages.

The operation for identifying the direction of the sound source will be performed in this state. The root circuit 540 will apply the voltages to the upper capacitors respectively for suppressing vibration of the diaphragm 200 while the diaphragm 200 receives acoustic waves. At the same time, the root circuit 540 will calculate a value subtracting a value of each stored bias voltage from a value of the voltage applying to each upper capacitor for suppressing vibration. The root circuit 540 will output the calculated values to the sound direction identification circuit 550. In other words, in FIG. 2, the bias voltages are included in the voltage values $V_5$, $V_6$, $V_7$, $V_8$ respectively that are applied from the root circuit 540 to the capacitors $C_5$, $C_6$, $C_7$, $C_8$ for vibration suppression, but the values subtracting the bias voltages from applying voltages respectively will output from the root circuit 540 to the sound source direction identification circuit 550.

Due to the process described above, the capacitance of each lower capacitor can always match the capacitance originally designed prior to identifying the direction of the sound source. Even if the shape of the diaphragm or the tilt of the diaphragm with respect to the supported center portion varies from design, the variation will be cancelled by the applied bias voltages. Therefore, the accuracy with which the direction of the sound source is identified will not decline.

Embodiment 4

Next, embodiment 4 will be described. The embodiment 4 is a microphone that will not identify the direction of the sound source, but rather only output electric signal to which acoustic waves propagating from a predetermined direction are converted. In other words, this is a microphone that has high directional characteristics.

The structure of the microphone of the embodiment 4 may be the same as the structure of the microphone 100 of the first embodiment. The structure of the controller may also be the same as the structure of the controller 500. The embodiment 4 is characterized by the process performed by the controller 500. Thus, FIG. 2 will be employed to describe the microphone of the embodiment 4.

As described in the first embodiment, the sound source direction identification circuit 550 of the controller 500 will identify the direction of the sound source based upon a predetermined relationship between the direction of the sound source and the phase difference of the vibration of each position of the diaphragm.

In the embodiment 4, the predetermined direction of the sound source will be stored in the sound source direction identification circuit 550 in advance. The sound source direction identification circuit 550 will identify the direction of the sound source while the diaphragm receives acoustic waves by the same way described in the first embodiment. The identified direction of the sound source will be compared to the stored predetermined direction in the sound source direction identification circuit 550. When the identified direction substantially matches the stored direction, the sound source direction identification circuit 550 will output electric signal to which the voltage applied to at least one of the capacitors of the upper capacitors (the actuators) is converted. The electric signal may be the voltage itself applied to at least one of the capacitors of the upper capacitors. The electric signal may be a DC current signal that is proportional to the voltage applied to one of the upper capacitors.

The output electric signal (voltage or current) may be proportional to the strength of the acoustic waves propagated along the predetermined direction to the diaphragm. In other words, the sound source direction identification circuit 550 can output electric signal that represents acoustic waves received by the diaphragm.

Due to the process described above, only the acoustic waves propagated from the stored pre4determed direction can be converted to electric signal (a voltage or a DC current), and output to an external device.

Embodiment 5

Next, the embodiment 5 will be described. The embodiment 5 employs the structure of the microphone of the first embodiment to achieve a microphone that has strong directional characteristics in the front of the microphone. Therefore, the microphone 100 shown in FIG. 1 is referred to as the microphone of this embodiment.

The microphone in the embodiment 5 comprises another controller (not shown in the drawings) to the microphone in the first embodiment. In the embodiment 5, each capacitor formed by each electrode pair arranged in the microphone 100 has the same capacitance when acoustic waves are not being received. The controller of the embodiment 5 will measure the capacitance of capacitors $C_1$ to $C_8$. A bridge circuit that uses (the capacitance of) each capacitor measured is configured so as to output electric signal in response to only acoustic waves that propagate from the front direction of the microphone.

Figure 8:
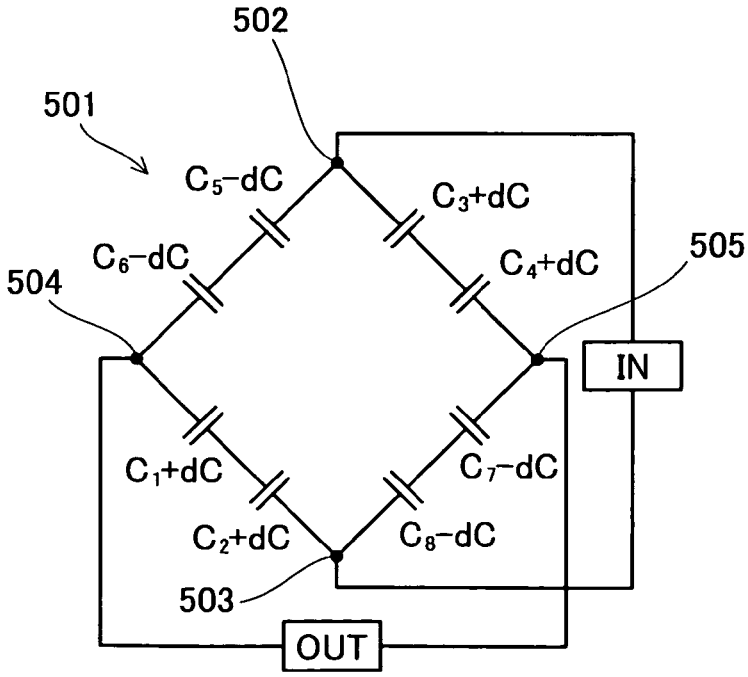
FIG. 8 is a drawing that describes the operation of a bridge circuit when a sound source is in the Z direction.
Figure 10:
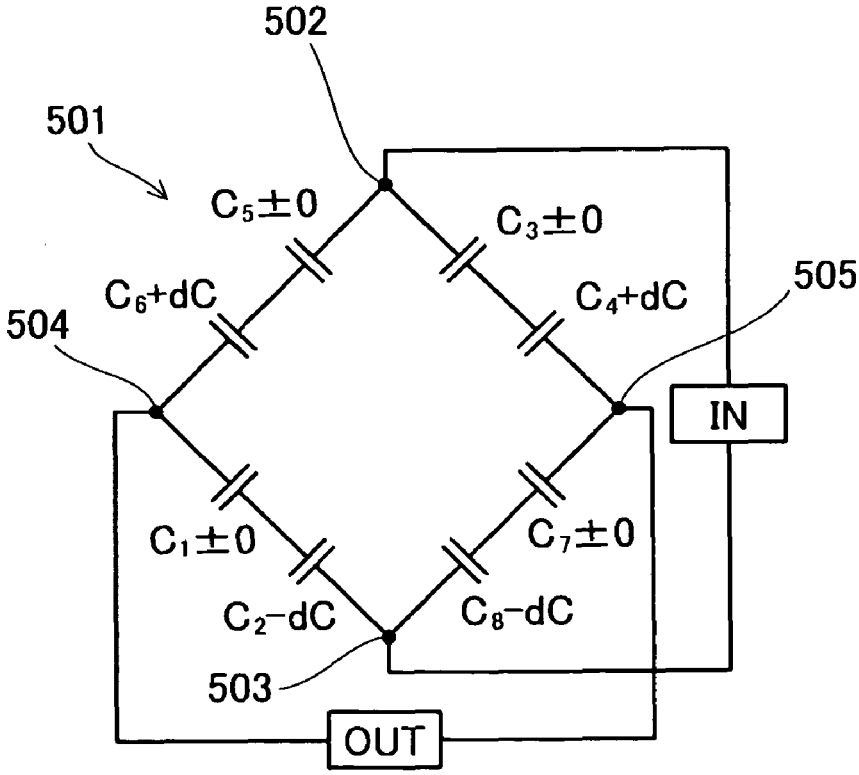
FIG. 10 is a drawing that describes the operation of a bridge circuit when a sound source is in a direction in an YZ plane that passes through the center of the diaphragm, and tilted at a predetermined angle from a Z axis.
Figure 12:
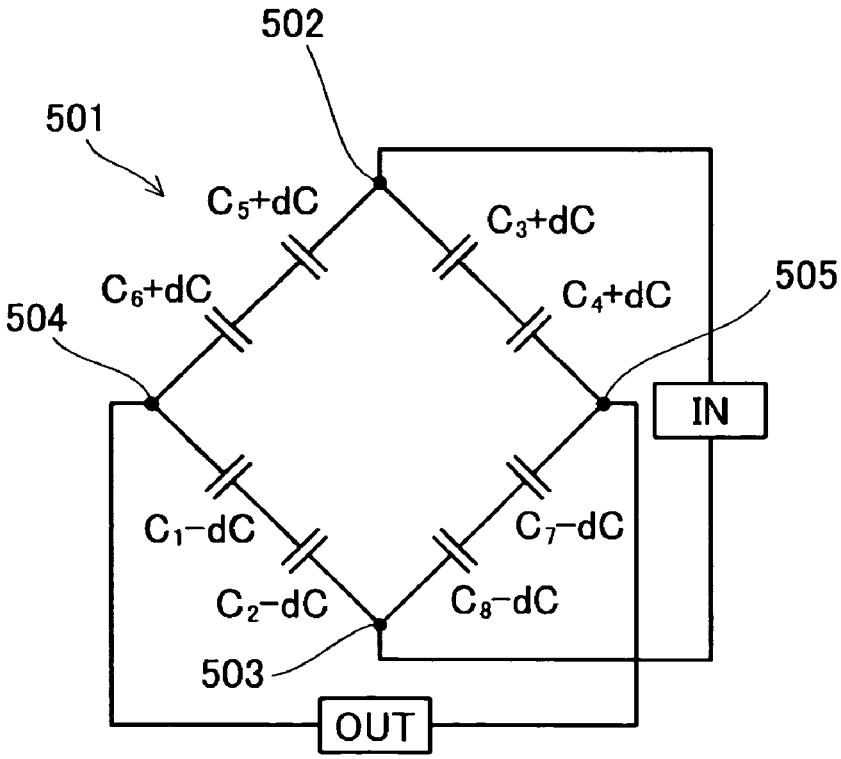
FIG. 12 is a drawing that describes the operation of a bridge circuit when a sound source is in a direction that passes through the center of the diaphragm in a plane in which an XZ plane is rotated 45 degrees around the Z axis, and tilted at a certain angle from a Z axis.

FIG. 7 depicts the configuration of a bridge circuit 501 that uses each capacitor formed by the first electrode pairs and the second electrode pairs. The reference symbols for each capacitor depicted in FIG. 7 are identical with those of the first embodiment. In FIG. 7, the reference symbols for each capacitor such as $C_1$ also represent the values of the capacitance when acoustic waves are not being received. In FIGS. 8, 10, and 12, the symbols such as $C_1$ have same meanings. Note as mentioned above, the capacitors $C_1$ to $C_8$ are formed so as to have same values of capacitance when acoustic waves are not being received, the capacitance represented by the symbols $C_1$ to $C_8$ are same. The capacitors $C_5$ and $C_6$ amongst the upper capacitors are connected in series between the first input terminal 502 and the second output terminal 504 of the bridge circuit 501. The first capacitors $C_3$ and $C_4$ amongst the lower capacitors are connected in series between the first input terminal 502 and the first output terminal 505. In addition, the first capacitors $C_1$ and $C_2$ amongst the lower capacitors are connected in series between the second input terminal 503 and the second output terminal 504. The capacitors $C_7$ and $C_8$ amongst the upper capacitors are connected in series between the second input terminal 503 and the first output terminal 505. A constant voltage will be supplied between the first input terminal 502 and the second input terminal 503.

When the diaphragm 200 vibrates by received acoustic waves, the capacitance of each of the capacitors $C_1$ to $C_8$ will change depending upon the direction of the sound source. Thus, when a bridge circuit 501 is formed as described above, a voltage value (a value of electric energy) can be output in response to an increase or decrease of the capacitance between the first output terminal 505 and the second output terminal 504 only when the capacitance of the lower capacitors $C_1$, $C_2$, $C_3$, $C_4$ increase or decrease in same phase.

The operation of the bridge circuit 501 will be described in detail. First, the operation of the bridge circuit 501 when a sound source is in the Z direction shown in FIG. 3 (when the direction of the sound source is in the front of the diaphragm).

When the sound source is in the Z direction, the all portions of diaphragm 200 will vibrate up and down in same phase. FIG. 3 shows the state of the entire diaphragm when bent toward the lower electrodes 140. At this point, the length of the gaps between the lower capacitors ($C_1$ to $C_4$) will shorten simultaneously. Thus, the capacitance of the lower capacitors ($C_1$ to $C_4$) will increase with same amount. The amount of increase in the lower capacitance $C_1$ to $C_4$ will represent by the symbol +dC. In contrast, the length of the gaps between the upper capacitors ($C_5$ to $C_8$) will lengthen. Thus, the capacitance of the upper capacitors ($C_5$ to $C_8$) will decrease with same amount. The amount of shorten of the gaps in the lower capacitors ($C_1$ to $C_4$) is equal to the amount of lengthen of the gap in the upper capacitors ($C_5$ to $C_8$) because the each upper capacitor and corresponding lower capacitor are aligned when viewed perpendicular to the diaphragm. Therefore, the amount of decrease in the capacitance will be represent symbol −dC.

The change in the capacitance of each capacitor of the bridge circuit 501 at this point is shown in FIG. 8. The capacitance between the first input terminal 502 and the second output terminal 504 will decrease by −2 dC. Likewise, the capacitance between the second input terminal 503 and the first output terminal 505 will also decrease by −2 dC. In contrast, the capacitance between the first input terminal 502 and the first output terminal 505 will increase by +2 dC. Likewise, the capacitance between the second input terminal 503 and the second output terminal 504 will also increase by +2 dC. At this point, due to the characteristics of the bridge circuit, a difference in electric potentials that is proportional to the amount of change in the capacitance will be produced between the first output terminal 505 and the second output terminal 504. A voltage will be output from the first output terminal 505 and the second output terminal 504 in response to the amount of change in the capacitance. "Output of a voltage between the first output terminal 505 and the second output terminal 504" will be hereinafter referred to simply as the "bridge output".

Figure 9:
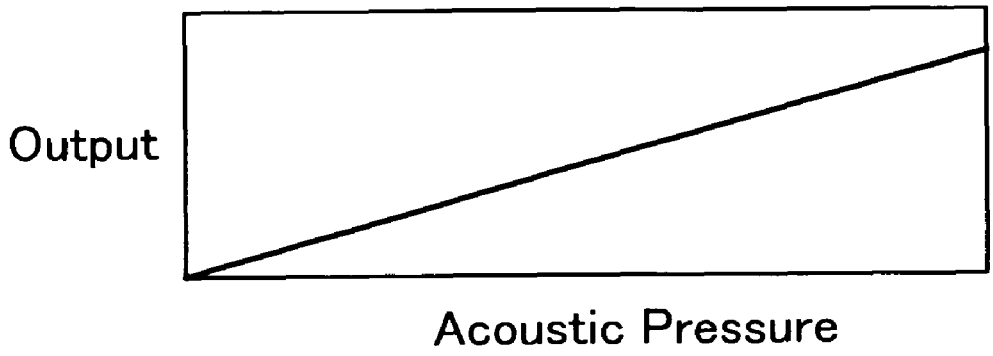
FIG. 9 is a drawing in which the output of a bridge circuit when a sound source is in the Z direction is schematically expressed.

The capacitance of the lower capacitors ($C_1$ to $C_4$) will increase in proportion to the acoustic pressure of the acoustic waves from the Z direction. This is the relationship shown in FIG. 9 between the acoustic pressure from the Z direction and the bridge output. In other words, when the sound source is in the Z direction (the direction of the front of the microphone 100), the bridge output will be obtained that is proportional to the acoustic pressure that the diaphragm 200 receives.

Next, the operation of the bridge circuit 501 will be described when a sound source is in a direction tilted at a certain angle from the Z axis in the YZ plane that passes through the center of the diaphragm 200 as shown in FIG. 4.

In this situation, the diaphragm 200 tilts around the X axis by receiving the acoustic waves those come from tilted direction. At this point, the capacitance of the capacitor $C_4$ amongst the lower capacitors will increase. At the same time, the capacitance of $C_6$ amongst the upper capacitors will also increase. The amount of increase in the capacitance will be +dC. In contrast, the capacitance of $C_2$ of the lower capacitors and $C_8$ of the upper capacitors will decrease. At the same time, the capacitance of $C_6$ amongst the upper capacitors will also increase. The amount of decrease in the capacitance will be −dC. At this point, the capacitance of $C_1$ and $C_3$ of the lower capacitors and $C_5$ and $C_7$ of the upper capacitors will not change.

Figure 11:
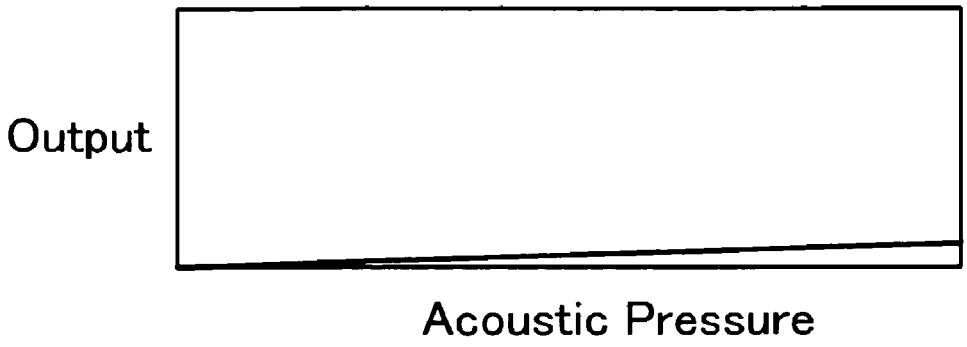
FIG. 11 is a drawing in which the output of a bridge circuit when a sound source is in a direction that passes through the center of the diaphragm in an YZ plane, and tilted at a certain angle from a Z axis, is schematically expressed.

The change in the capacitance of each capacitor of the bridge circuit 501 at this point is shown in FIG. 10 schematically. The capacitance between the first input terminal 502 and the second output terminal 504 will be substantially the same value as the capacitance between the first input terminal 502 and the first output terminal 505. Likewise, the capacitance between the second input terminal 503 and the second output terminal 504 will be substantially the same value as the capacitance between the second input terminal 503 and the first output terminal 505. Thus, a difference in electric potentials will not be produced between the first output terminal 505 and the second output terminal 504 substantially, although a small amount of a difference in electric potentials may be produced by errors in construction of the microphone. Thus, the bridge output will be the relationship shown in FIG. 11 schematically when a sound source is in a direction that passes through the center of the diaphragm in the YZ plane and is tilted from the Z axis by a certain angle. In other words, in this situation, the bridge output can be made to be almost zero even when the acoustic pressure is large.

Next, the operation of the bridge circuit 501 will be described when a sound source is in a direction that passes through the center of the diaphragm 200 in a plane in which the XZ plane is rotated 45 degrees around the Z axis, and is tilted at a certain angle from the Z axis as shown in FIG. 5.

In this situation, the diaphragm 200 is tilted in a plane in which the XZ plane was rotated 45 degrees around the Z axis by receiving the acoustic waves that come from tilted direction. At this point, the capacitance of $C_3$ and $C_4$ of the lower capacitors and $C_5$ and $C_6$ of the upper capacitors will increase. The amount of increase in the capacitance will be +dC. In contrast, the capacitance of $C_1$ and $C_2$ of the lower capacitors and $C_7$ and $C_8$ of the upper capacitors will decrease. The amount of decrease in the capacitance will be −dC.

Figure 13:
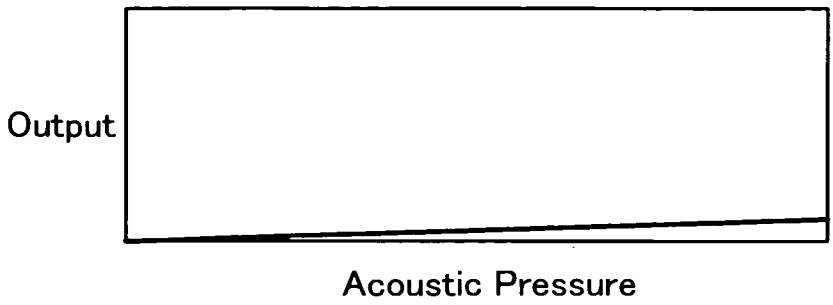
FIG. 13 is a drawing in which the output of a bridge circuit when a sound source is in a direction that passes through the center of the diaphragm in a plane in which an XZ plane is rotated 45 degrees around the Z axis, and tilted at a predetermined angle from a Z axis, is schematically expressed.

The change in the capacitance of each capacitor of the bridge circuit 501 at this point is shown in FIG. 12. Due to the characteristics of the bridge circuit, a difference in electric potentials will not be produced between the output terminals in this situation (a small amount of difference in electric potentials may be produced by errors). Thus, the bridge output will be the relationship shown in FIG. 13 schematically when a sound source is in a direction that passes through the center of the diaphragm in a plane in which the XZ plane is rotated 45 degrees around the Z axis, and is tilted from the Z axis by a certain angle. In other words, in this situation as well, the bridge output can be made to be almost zero even when the acoustic pressure is large.

As described above, according to the embodiment 5, a microphone having strong directional characteristics in the front direction thereof can be achieved. The structure of this microphone is the same as the structure of the first embodiment. Thus, a reduction in size is possible. The microphone in the embodiment 4 also has directional characteristics. However, the microphone of the embodiment 5 differs in that the capacitance, of the capacitors arranged on both surfaces of the diaphragm, are connected to the bridge circuit. The bridge circuit can detect minute differences in the capacitance of each capacitor. The directional characteristics of the microphone can be improved. In addition, a microphone having strong directional characteristics can be achieved with a simple structure in which the capacitors arranged on both surfaces of the diaphragm are connected to the bridge circuit. In other words, due to the present embodiment, the arrangement of the first electrode pairs and the second electrode pairs on the diaphragm is suitable for a structure having strong directional characteristics in the front thereof.

In the embodiment 5, the electrode pairs formed by the lower electrodes (141, 142, 143, 144) and corresponding electrodes arranged on the diaphragm 200 facing thereto correspond to the first electrode pairs recited in the claims. The capacitors $C_1$, $C_2$, $C_3$, $C_4$ formed by each first electrode pair correspond to the first capacitors. In addition, the electrode pairs formed by the lower electrodes (321, 322, 323, 324) and corresponding electrodes arranged on the diaphragm 200 facing thereto correspond to the second electrode pairs recited in the claims. The capacitors $C_5$, $C_6$, $C_7$, $C_8$ formed by each second electrode pair correspond to the second capacitors.

In the embodiment 5, a constant voltage is applied between the first input terminal 502 and the second input terminal 503. A constant current may be applied instead of a constant voltage. When a constant current is applied between the first input terminal 502 and the second input terminal 503, the bridge output between the first output terminal 505 and the second output terminal 504 will be a current value.

Note that the configuration of the bridge circuit described above can be expressed as follows.

(1) The bridge circuit has a pair of input terminals and a pair of output terminals.

(2) The capacitors amongst the first capacitors arranged within a half region of the diaphragm are connected in series between one input terminal and one output terminal.

(3) The capacitors amongst the first capacitors arranged within the other half region of the diaphragm are connected in series between the other input terminal and the other output terminal.

(4) The capacitors amongst the second capacitors arranged within the other half region of the diaphragm are connected in series between the one input terminal and the other output terminal.

(5) The capacitors amongst the second capacitors arranged within the one half region of the diaphragm are connected in series between the other input terminal and the one output terminal.

(6) A predetermined electric energy is applied between the two input terminals.

This expression will be described in detail with FIGS. 1 and 7. In FIG. 7, the bridge circuit 501 comprises a pair of input terminals, namely, a first input terminal 502 (the one input terminal) and a second input terminal 503 (the other input terminal). In addition, the bridge circuit 501 comprises a pair of output terminals, namely, a first output terminal 505 (the one output terminal) and a second output terminal 504 (the other output terminal).

The capacitors $C_3$ and $C_4$ amongst the first capacitors arranged within the half region of the diaphragm 200 are connected in series between the first input terminal 502 and the first output terminal 505.

The capacitors $C_1$ and $C_2$ amongst the first capacitors arranged in the other half region of the diaphragm 200 are connected in series between the second input terminal 503 and the second output terminal 504.

The capacitors $C_5$ and $C_6$ amongst the second capacitors arranged within the other half region of the diaphragm 200 are connected in series between the first input terminal 502 and the second output terminal 504.

The capacitors $C_7$ and $C_8$ amongst the second capacitors arranged within the half region of the diaphragm 200 are connected in series between the second input terminal 503 and the first output terminal 505.

Note that in the embodiment 5, "the half region of the diaphragm 200" is the lower right half of the region divided into two by the line L in FIG. 1. The capacitors $C_3$ and $C_4$ amongst the first capacitors are the capacitors that are formed by the first electrode pairs arranged within "the half region".

In addition, "the other half region of the diaphragm 200" is the upper left half of the region divided into two by the line L in FIG. 1. The capacitors $C_1$ and $C_2$ amongst the first capacitors are the capacitors that are formed by the first electrode pairs arranged within "the other half region".

Similarly, the capacitors $C_7$ and $C_8$ amongst the second capacitors are the capacitors that are formed by the second electrode pairs arranged within "the half region". The capacitors $C_5$ and $C_6$ amongst the second capacitors are the capacitors that are formed by the second electrode pairs arranged within "the other half region".

"The half region of the diaphragm 200" and "the other half region of the diaphragm 200" mean each of the two regions of the diaphragm when viewed from the perpendicular direction.

The capacitors $C_3$ and $C_4$ amongst the first capacitors are arranged within the half region of the diaphragm 200 on one side of the diaphragm 200. The capacitors $C_5$ and $C_6$ amongst the second capacitors are arranged within the other half region of the diaphragm 20 on the other side of the diaphragm.

In other words, the $C_3$ and $C_4$ capacitors and the $C_5$ and $C_6$ capacitors are arranged in symmetrical positions when the diaphragm is viewed from the front and rear sides thereof in a direction that is perpendicular to the surfaces thereof. Therefore, when the all portions of the diaphragm vibrate in the same phase, the change in the capacitance of the $C_3$ and $C_4$ capacitors will be in anti-phase with the change in the capacitance of the $C_5$ and $C_6$ capacitors.

Therefore, the capacitance between the first input terminal 502 and the first output terminal 505 will be different that the capacitance between the first input terminal 502 and the second output terminal 504. Thus, a difference in electric potentials will be produced between the first output terminal 505 and the second output terminal 504. Due to this difference in electric potential, current will flow between the two output terminals.

In contrast, the capacitors $C_3$ and $C_4$ amongst the first capacitors and the capacitors $C_5$ and $C_6$ amongst the second capacitors are arranged in symmetrical positions. Therefore, even when the diaphragm tilts in any direction and vibrates, the capacitance of both groups of capacitors will be equal. Thus, a difference in electric potentials will not be produced between the two output terminals. The same also applies to the other capacitors $C_1$, $C_2$, $C_7$, and $C_8$.

In other words, a microphone having strong directional characteristics in the front direction thereof can be achieved.

Note that in the embodiment 5, the capacitance of the capacitors formed by the first electrode pairs and the second electrode pairs arranged on both surfaces of the diaphragm changes in accordance with the changes in each position of the diaphragm. The concept of the present invention is not limited to capacitors, and includes devices that output an electric signal that changes in accordance with changes in each position of the diaphragm. This means that the present invention can also be expressed as follows. The microphone according to the present invention comprises a diaphragm, first sensors, second sensors, and a bridge circuit. Here, the diaphragm is supported at the center thereof, and which vibrates with acoustic waves. The first sensors are distributed on one side of the diaphragm around the center of the diaphragm. Each first sensor outputs electric signal corresponding to a displacement of the diaphragm at a position facing the first sensor. The second sensors are distributed on the other side of the diaphragm around the center of the diaphragm. Each second sensor outputs electric signal corresponding to a displacement of the diaphragm at a position facing the second sensor. The bridge circuit electrically connects the first sensors and the second sensors, wherein the bridge circuit is formed so as to output electric signal corresponding to the electric signal outputted from at least one of the first sensors when values of the electric signals outputted from the first sensors have a predetermined relationship.

Note that the predetermined relationship is the timing at which the values of electric signals output by the first sensor increase and decrease in same phase when the diaphragm receives acoustic waves that come from the front direction, and each position surrounding the center portion of the diaphragm vibrates at the same phase. The bridge circuit is configured so that at least one sensor output will be obtained from the first sensors when the values of electric signals output from the first sensors are in the predetermined relationship. One example of the predetermined relationship is the relationship in which the values of electric signals output from the first sensors increase and decrease in the same phase. As illustrated in the present embodiment, a bridge circuit that obtains output signal when values of electric signals output by the first sensors increase and decrease in the same phase can be simply constructed.

Here, in addition to capacitors, piezoelectric elements, piezoresistors, and the like may be employed as the first sensors and second sensors. In addition, a displacement measurement device may be employed. In this situation, the sensors arranged on one surface of the diaphragm 200 correspond to the first sensors. The sensors arranged on the other surface of the diaphragm 200 correspond to the second sensors.

Embodiment 6

Next, the embodiment 6 of the invention will be described. The embodiment 6 is characterized in that the structure of the diaphragm that is supported at the center portion thereof described in common with the above embodiments. The diaphragm of this embodiment has a structure in which the supported center portion and portions other than the center portion are connected by a biaxial gimbal.

Figure 14:
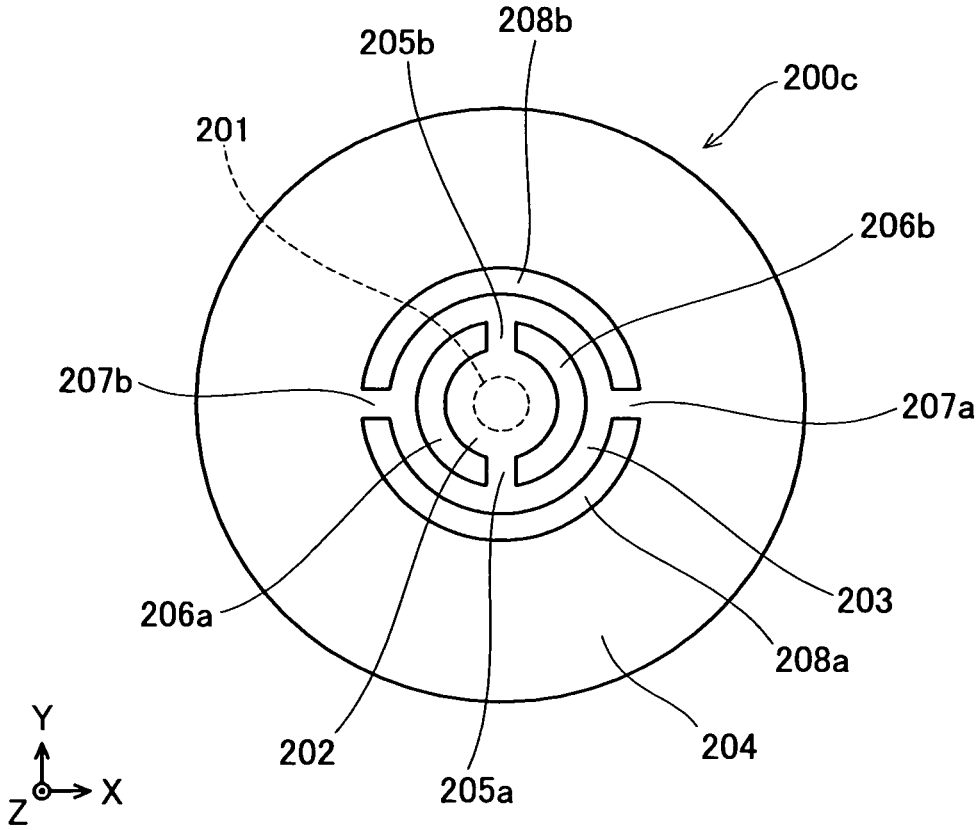
FIG. 14 is a plan view of a diaphragm of the sixth embodiment.

A plan view of a diaphragm 200*c* of the embodiment is shown in FIG. 14. This diaphragm 200*c* is basically constructed from a circular center portion 202, a ring-shaped ring portion 203 having a narrow width, and a ring-shaped periphery 204 having a wide width. The periphery 204 substantially serves as a diaphragm that receives acoustic waves and vibrates.

The center portion 202 is supported by a support member 201 on the rear side of the diaphragm. Thus, the center portion 202 is fixed to, for example, the frame (not shown in FIG. 14, see FIG. 1) of the microphone. The center portion 202 will not vibrate even when the diaphragm receives acoustic waves. The center portion 202 and the ring portion 203 are connected by two inner connecting members 205*a*, 205*b*. The two inner connecting members 205*a*, 205*b* are arranged in symmetric positions with respect to the center of the center portion 202. The center portion 202 and the ring portion 203 are only connected by the two inner connecting members 205*a*, 205*b*. Thus, two inner holes 206*a*, 206*b* are formed between the center portion 202 and the ring portion 203. The two inner connecting members 205*a*, 205*b* are formed such that the widths thereof are narrow. This is in order to reduce the rigidity of the inner connecting members 205*a*, 205*b*. In this way, the ring member 203 can be displaced in the Z direction with respect to the center portion 202. In addition, rotation around the Y axis is made possible.

The ring portion 203 and the periphery 204 are connected by two outer connecting members 207*a*, 207*b*. The two outer connecting members 207*a*, 207*b* are arranged in symmetric positions with respect to the center of the center portion 202. In addition, the two outer connecting members 207*a*, 207*b* are arranged in positions that are rotated 90 degrees with respect to the inner connecting members 205*a*, 205*b* that connect the center portion 202 and the ring portion 203. The ring portion 203 and the periphery 204 are connected only by the two outer connecting members 207*a*, 207*b*. Thus, two outer holes 208*a*, 208*b* are formed between the ring portion 203 and the periphery 204. The two outer connection members 207*a*, 207*b* are formed such that the widths thereof are narrow. This is in order to reduce the rigidity of the inner connection members 207*a*, 207*b*. Thus, the periphery 204 can be displaced in the Z direction with respect to the ring portion 203. In addition, rotation around the X axis is made possible.

The periphery 204 is connected to the center portion 202 by the outer connecting members 207*a*, 207*b* in the X axis direction. In addition, the periphery 204 is connected to the center portion 202 by the inner connecting members 207*a*, 207*b* in the Y axis direction. The periphery 204 is connected to the center portion 202 in the X axis and the Y axis direction, and can be rotated around each axis. A biaxial gimbal is formed thereby.

Due to this construction, the ring member 204 can be displaced in the Z direction with respect to the center portion 202. In addition, rotation around the X axis and the Y axis is made possible.

Due to the construction described above, the rigidity of the periphery 204 can be increased. Even if the rigidity of the periphery 204 is increased, the periphery 204 can be displaced in the Z direction with respect to the center portion 202. In addition, rotation around the X axis and the Y axis is made possible. Due to this structure, the periphery 204 that receives acoustic waves can be displaced in the Y axis and Z axis directions while the rigidity of the periphery 204 itself can be increased. Each position on the periphery 204 can vibrate depending upon the direction of the sound source.

In addition, the higher order eigenfrequencies of the periphery 204 can be increased by increasing the rigidity of the periphery 204. There is no longer any need to consider the higher order vibration mode of the periphery (substantially the diaphragm) when identifying the direction of the sound source. Identification of the direction of the sound source will be simplified.

Furthermore, the durability of the periphery 204 itself can be improved by increasing the rigidity of the periphery 204.

Embodiment 7

Next, a method of manufacturing the microphone described in the embodiments will be described. This method uses semiconductor process technology. Thus, a microphone can be manufactured that is extremely small in size.

The method of manufacturing of the present embodiment includes the following steps.

(1) A step in which a first sacrifice layer is formed on the surface of a semiconductor laminated substrate in which a silicon substrate, an insulation film, and a silicon film are laminated together, such that the first sacrifice layer surrounds a predetermined region of a lower semiconductor layer that is the uppermost layer of the substrate.

(2) A step in which an upper semiconductor layer is formed so as to cover the first sacrifice layer and the surface of the predetermined region exposed in the center of the first sacrifice layer.

(3) A step in which the first sacrifice layer is removed by means of an etchant.

The first sacrifice layer will be formed so as to surround the predetermined region of the lower semiconductor surface by means of manufacturing steps that include the steps described above. Thus, this predetermined region will be a structure in which a diaphragm is supported with respect to the surface layer.

This method of manufacturing preferably includes the following additional steps.

(4) A step of forming a second sacrifice layer that covers from the surface of the first sacrifice layer near the edge thereof to the surface of the upper semiconductor layer.

(5) A step of forming a backplate layer that covers from the lower semiconductor surface surrounding the first sacrifice layer to a position facing at least the periphery of the upper semiconductor layer on the surface of the second sacrifice layer.

(6) A step in which the second sacrifice layer is removed by means of an etchant.

Due to step (5) described above, a backplate layer will be formed that covers from the lower semiconductor surface surrounding the first sacrifice layer to a position on the second sacrifice layer, the position facing at least the periphery of the upper semiconductor layer. Due to this step, a backplate layer that extends from the surface of the lower semiconductor layer around the first sacrifice layer to a position facing at least the periphery of the upper semiconductor layer (i.e., diaphragm) when viewed from above of the upper semiconductor layer can be formed. In order for the second sacrifice layer between the backplate layer and the semiconductor layer to be removed by means of etching, the backplate layer and the upper semiconductor layer do not come into contact with each other. A diaphragm can be formed in which the periphery thereof is capable of being freely vibrated in the thickness direction. By providing electrodes on the front and rear surfaces of the diaphragm in the microphone manufactured as described above, and providing electrodes on the surface of the backplate on the side facing the diaphragm, a microphone having opposing electrode pairs on the front and rear surfaces of the diaphragm can be manufactured.

Due to step (5) described above, when a backplate layer that extends from the lower semiconductor layer around the upper semiconductor layer (i.e., diaphragm) to a position facing at least the periphery of the upper semiconductor layer when viewed from above is formed, an opening will be formed in the center of the backplate layer. This opening will serve to transmit acoustic waves from the exterior of the microphone to the diaphragm thereof.

Note that the backplate layer may be formed so as to cover the entire surface of the second sacrifice layer. In this case, a large number of through holes will be provided in the backplate. Due to this through holes, acoustic waves propagating from the exterior of the microphone will reach the diaphragm.

FIGS. 15 to 27 will be employed below to describe a method of manufacturing a microphone according to the present embodiment.

Figure 15:
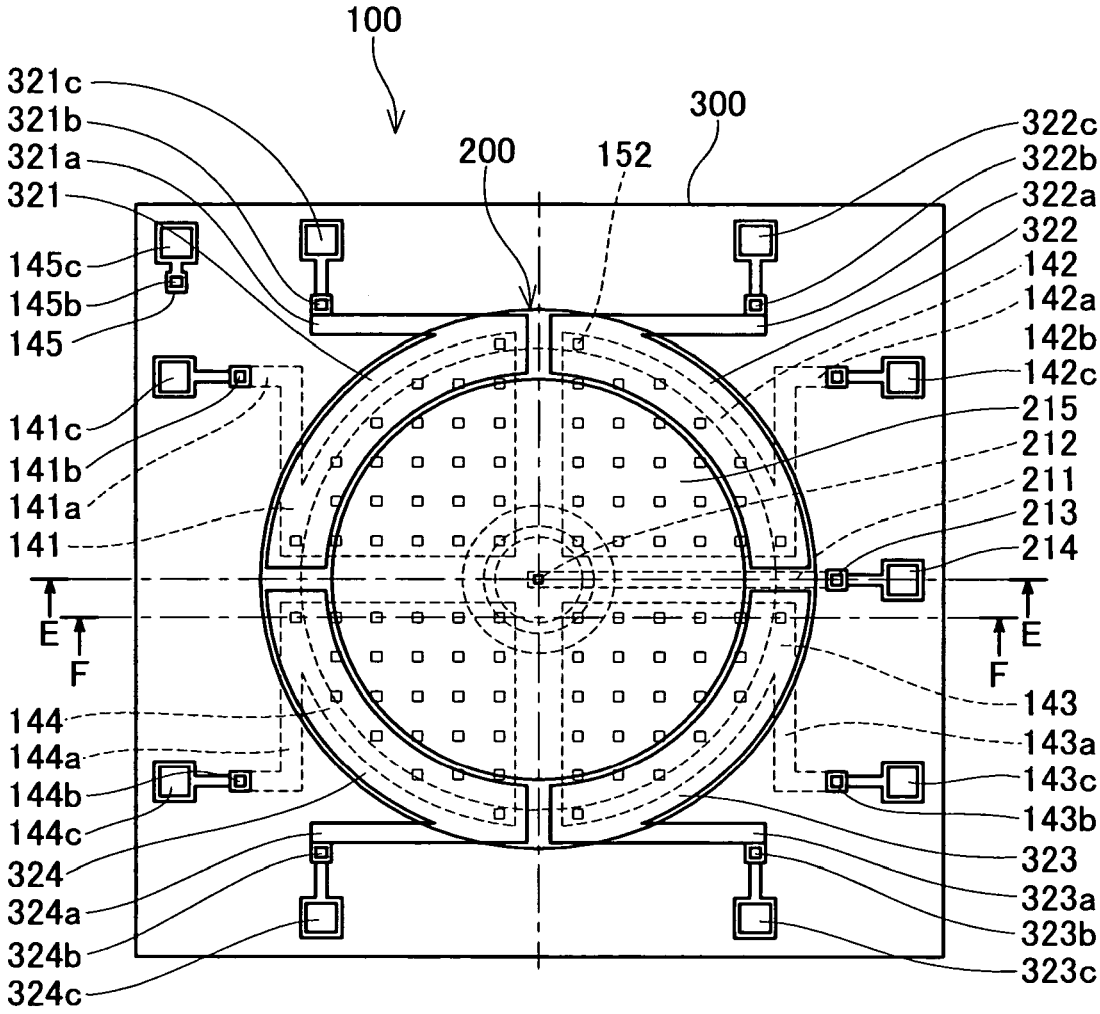
FIG. 15 is a plan view of a diaphragm of the seventh embodiment.
Figure 16:
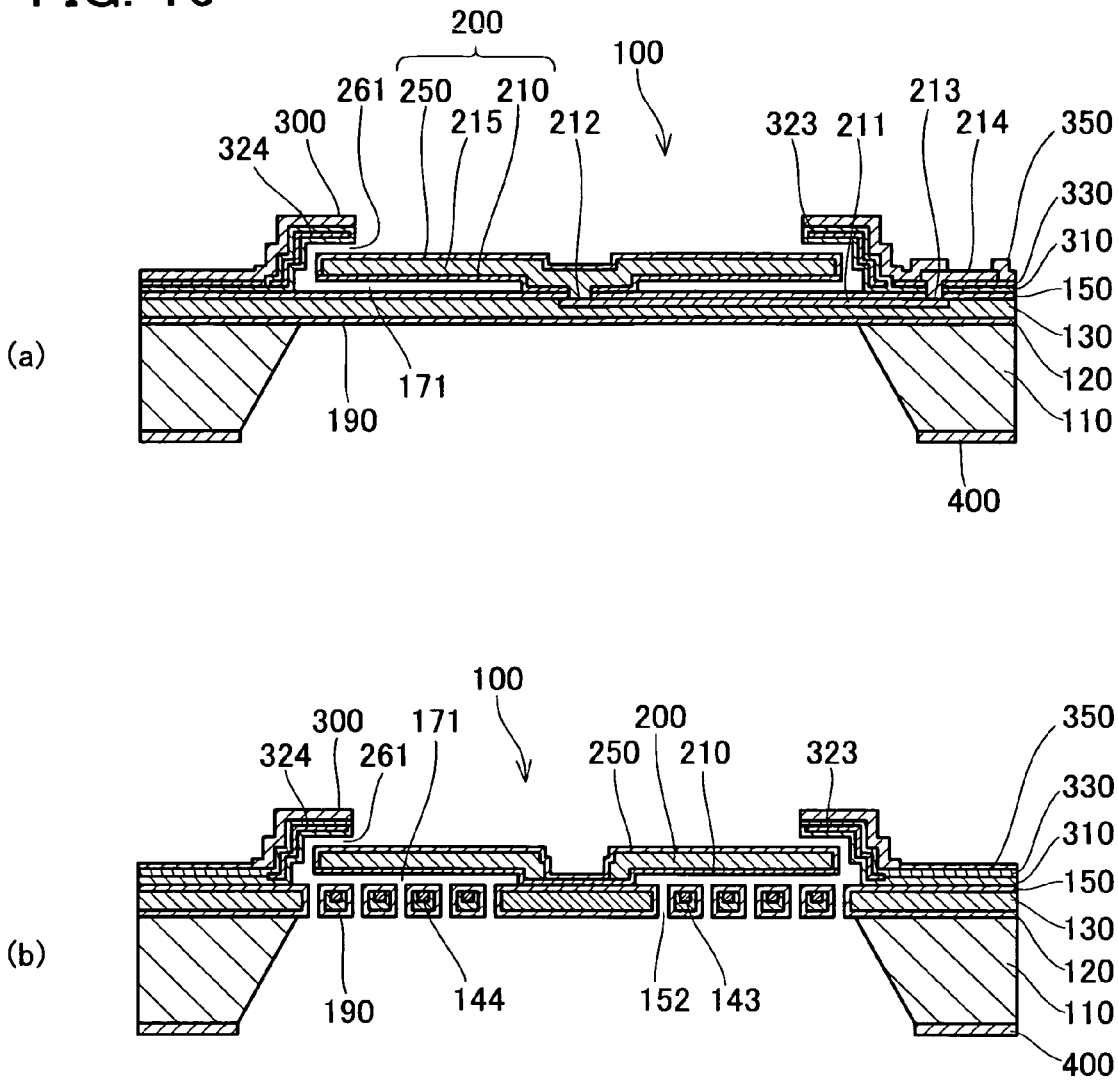
FIG. 16(*a*) is a vertical cross-section view corresponding to line E-E shown in FIG. 15.

First, FIGS. 15 and 16 will be employed to briefly describe the structure of the microphone 100. FIG. 15 is a plan view of the microphone 100. FIG. 16(*a*) is a vertical cross-section view corresponding to line E-E of FIG. 15. FIG. 16(*b*) is a vertical cross-section view corresponding to line F-F of FIG. 15.

The diaphragm 200 is interposed between an upper backplate 300 and a lower backplate 190. The diaphragm 200 is fixed in the center portion thereof via several layers formed on the lower backplate 190.

Four upper electrodes 321, 322, 323, 324 are arranged on the rear side of the portion of the upper backplate 300 that overlaps with the diaphragm 200. An electrode lead 321*a* is wired on the upper backplate 300 from the upper electrode 321. The electrode lead 321*a* is connected to an upper electrode terminal 321*c* via an upper electrode contact 321*b*. An external device (a controller) will be connected by means of the upper electrode terminal 321*c*. Likewise, electrode leads 322*a*, 323*a*, 324*a* are wired on the upper backplate 300 from the upper electrodes 322, 323, 324. Each electrode lead is connected to upper electrode terminals 322*c*, 323*c*, 324*c* via upper electrode contacts 322*b*, 323*b*, 324*b*.

Four lower electrodes 141, 142, 143, 144 are arranged on the upper backplate 190 in positions that overlap with the diaphragm 200. An electrode lead 141*a* is wired from the lower electrode 141 to outside the diaphragm 200. The electrode lead 141*a* is connected to a lower electrode terminal 141*c* via a lower electrode contact 321*b*. An external device (a controller) will be connected by means of the lower electrode terminal 141*c*. Likewise, electrode leads 142*a*, 143*a*, 144*a* are wired from the lower electrodes 142, 143, 144 to outside the diaphragm 200. Each electrode lead is connected to lower electrode terminals 142*c*, 143*c*, 144*c* via lower electrode contacts 142*b*, 143*b*, 144*b*.

A diaphragm electrode 215 is arranged on the diaphragm 200. The diaphragm electrode 215 is connected to a diaphragm electrode 214 on the backplate 300 via a diaphragm electrode first contact 212, a diaphragm electrode 211, and a diaphragm electrode second contact 213.

In addition, a silicon film electrode 145 is connected to a silicon film electrode terminal 145*c* on the backplate 300 via a silicon film electrode contact 145*b*, and serves as a ground for each electrode of the microphone.

Air holes 152 are provided in the lower backplate 190 in positions that overlap with the diaphragm 200. The air holes 152 serve to prevent the diaphragm 200 from receiving pressure from the air between the backplate and the diaphragm. Note that in FIG. 15, the through holes 152 are drawn with fine lines in order to make it easier to view, though the positions thereof are on the rear side of the diaphragm 200.

A first diaphragm insulation film 210 is formed on the surface of the diaphragm 200 facing the lower backplate 190. In addition, a second diaphragm insulation film 250 is formed on the surface of the diaphragm 200 on the upper backplate 300 side. The first diaphragm insulation film 210 and the second diaphragm insulation film 250 are provided in order to prevent a short circuit between the electrodes on the diaphragm 200 and the electrodes arranged above and below the diaphragm 200.

A second void 261 is provided between the diaphragm 200 and the upper backplate 300. A first void 171 is provided between the diaphragm 200 and the lower backplate 190. These voids are provided as gaps between the electrodes arranged on the diaphragm 200 and the electrodes arranged on the backplates (the upper backplate 300 and the lower backplate 190) so the diaphragm 200 can vibrate without contacting the backplates.

The structure of the laminated member is as follows. A silicon substrate etching mask 400 is the lowermost layer. A silicon substrate 110 is formed on top thereof. An insulation film 120 is formed on top thereof. A silicon film 130 is formed on top thereof. A trench etching mask 150 is formed on top thereof. A first backplate insulation film 310 is formed on top thereof. A second backplate insulation film 330 is formed on top thereof. A third backplate insulation film 350 is formed on top thereof.

Next, FIGS. 17 to 27 will be employed to describe a method of manufacturing that forms the structure described above. Note that each of FIG. 17 to 27 shows the microphone at corresponding manufacturing step, and also shows a vertical cross-section view corresponding to FIG. 16(*b*).

Figure 17:
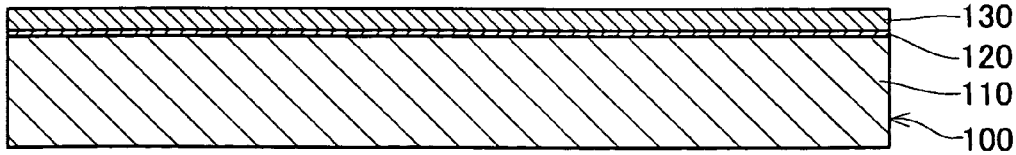
FIG. 17 to FIG. 27 are drawings that depict the manufacturing steps of the microphone of seventh embodiment.

First, as shown in FIG. 17, an SIO wafer substrate 100 will be prepared, and is formed of a silicon substrate 110 comprising single crystal silicon containing n-type impurities, an insulation film 120 comprising a silicon oxide film, and a silicon film 130 comprising single crystal silicon containing n-type impurities. (100) was selected as the plane orientation of the silicon substrate 110 and the silicon film 130. The thickness of the silicon substrate 110 in the layer thickness direction is approximately 400 micrometers. The thickness of the silicon film 130 in the layer thickness direction is approximately 10 micrometers.

Figure 18:
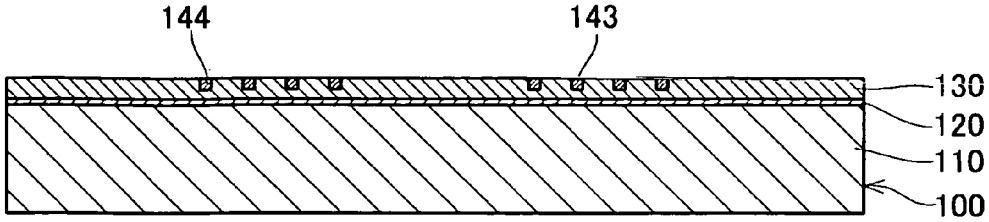

Next, as shown in FIG. 18, after boron is ion implanted on the surface of the silicon film 130 by photolithography, the four lower electrodes 141, 142, 143, 144 (electrodes 141 and 142 are not shown in the drawings) will be formed by means of an active anneal. Next, after phosphorous is ion implanted on the surface of the silicon film 130 by photolithography, the silicon film electrode 145 (not shown in the drawings) will be formed by means of an active anneal.

Figure 19:
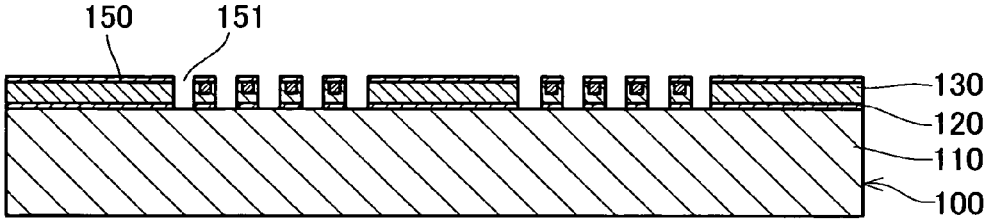

Next, as shown in FIG. 19, a silicon oxide film (NSG) trench etching mask 150 will be formed on the silicon film 130 by plasma CVD. A portion of the mask 150 will then be removed by means of photolithography and reactive ion etching (RIE), and patterning will be performed. Note that the SIO wafer substrate 100 corresponds to the "semiconductor substrate" recited in the claims.

Next, the silicon film 130 is trench etched to form trench etching openings 151. The insulation film 120 exposed by the trench etching will be removed by means of RIE.

Figure 20:
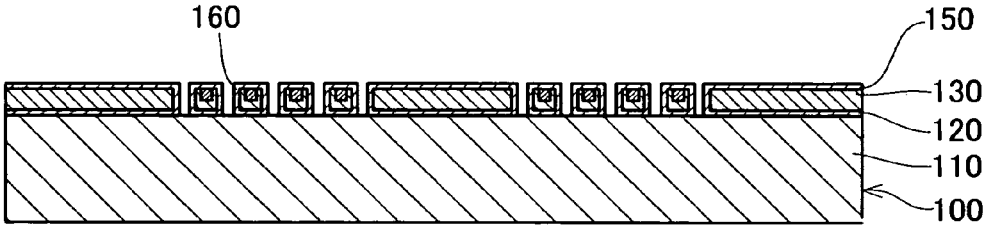

Next, as shown in FIG. 20, thermal oxidation will be performed in order to protect the side walls of the silicon film 130 exposed by the trench etching, and a silicon layer protection film 160 will be formed thereby. When the thermal oxidation is performed, the silicon substrate 110 exposed on the bottom of the trench etching openings 151 will also be thermally oxidized. This will be removed by RIE after thermal oxidation.

Figure 21:
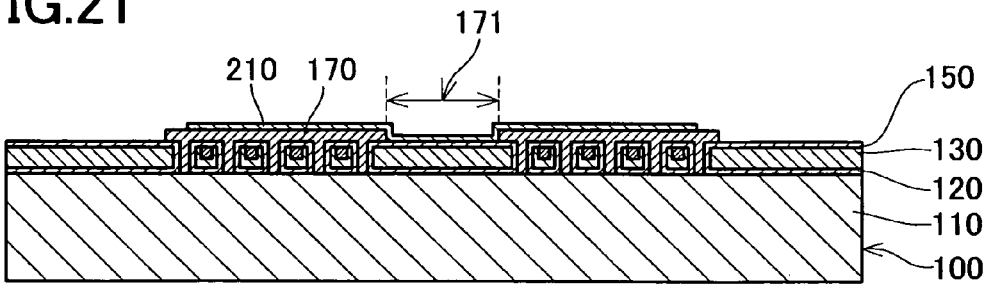

Next, as shown in FIG. 21, a polycrystalline silicon (poly-Si) first sacrifice layer 170 (corresponding to the first sacrifice layer recited in the claims) deposited by means of low pressure CVD is formed on the silicon film 130. The trench etching portions are filled with the polycrystalline silicon of the first sacrifice layer 170.

Here, the first sacrifice layer 170 will be formed so as to surround a predetermined region 171 on the surface of the silicon film.

Next, patterning will be performed by means of photolithography and RIE in order to define the region of the first sacrifice layer 170.

Next, an NSG first diaphragm insulation film 210 will be formed on the first sacrifice layer 170, and patterning will be performed by means of photolithography and RIE.

Figure 22:
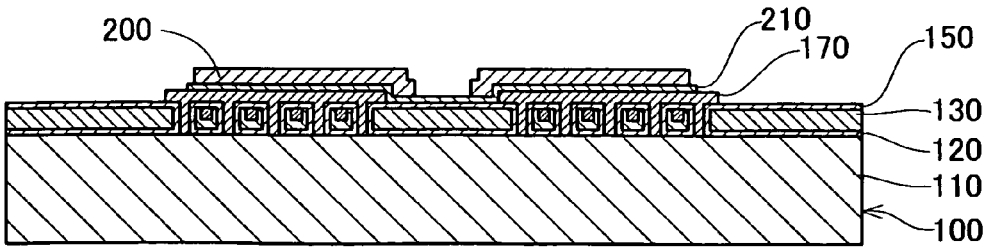

Next, as shown in FIG. 22, a layer of amorphous silicon (a-Si) deposited by means of low pressure CVD will be formed on the first diaphragm insulation film 210, and phosphorous will be ion implanted therein. An active anneal will be performed thereafter. Thus, the a-Si will become poly-Si having conductivity. In other words, the entire poly-Si layer will become the diaphragm electrode 215.

Next, the diaphragm electrode 215 will be patterned by means of photolithography and RIE.

Figure 23:
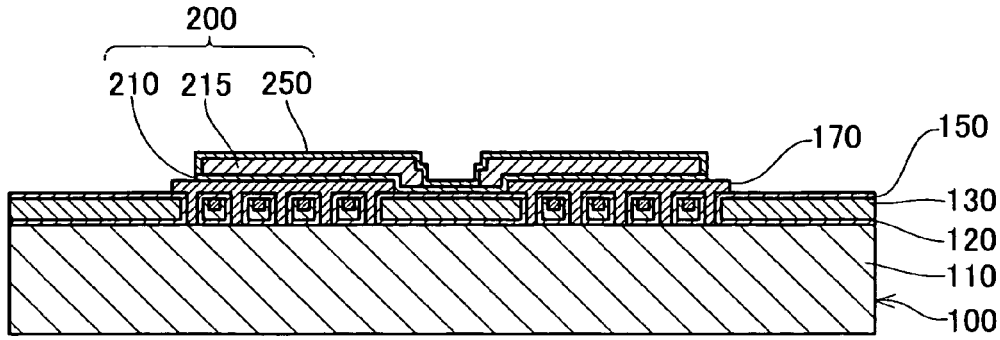

Next, as shown in FIG. 23, an NSG second diaphragm insulation film 250 will be formed so as to cover the diaphragm electrode 215, and patterning will be performed by means of photolithography and RIE.

Note that the first diaphragm insulation film 210, the diaphragm electrode 215, and the second diaphragm insulation film 250 are collectively the diaphragm 200. In addition, the steps of forming the first diaphragm insulation film 210, the diaphragm electrode 215, and the second diaphragm insulation film 250 correspond to "forming a sacrifice layer" recited in the claims.

Figure 24:
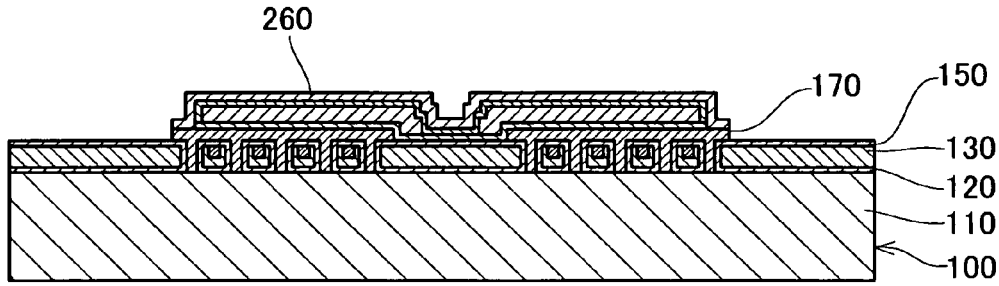

Next, as shown in FIG. 24, a poly-Si second sacrifice layer 260 will be formed on the second diaphragm insulation film 250, and the region of the second sacrifice layer 260 will be defined by means of photolithography and RIE. Note that this step corresponds to "forming a second sacrifice layer" recited in the claims.

Figure 25:
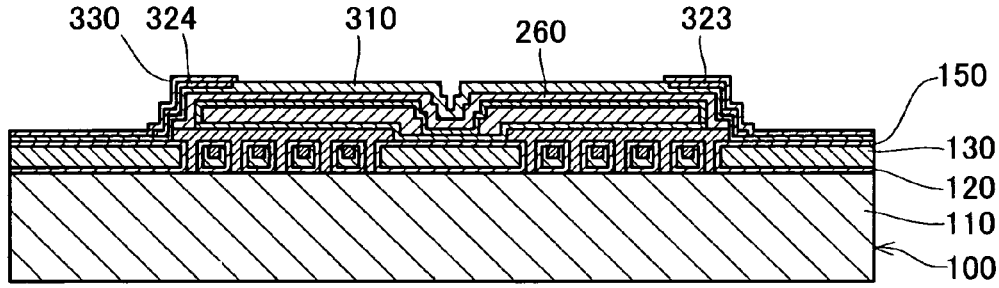

Next, as shown in FIG. 25, a silicon nitride film (LP—SiN) first backplate insulation film 310 that is deposited by means of low pressure CVD will be formed so as to cover the second sacrifice layer 260 from the mask 150 (the lower semiconductor surface) surrounding the first sacrifice layer 170.

Next, poly-Si upper electrodes (324 etc.) will be formed on the first backplate insulation film 310, and phosphorous will be ion implanted therein. An active anneal will be performed thereafter.

Next, the upper electrodes will be patterned by means of photolithography and RIE in order to form the four upper electrodes 321, 322, 323, 324 (321 and 322 are not shown in the drawings).

Next, an LP—SiN second backplate insulation film 330 will be formed so as to cover the upper electrodes 320.

Next, a portion of the second backplate insulation film 330, the first backplate insulation film 310, and the trench etching mask 150, will be removed by means of photolithography and RIE in order to form the four lower electrode contacts 141*b*, 142*b*, 143*b*, 144*b* (the four lower electrode contacts not shown in the drawings) and the silicon film electrode contact 145*b* (not shown in the drawings).

In addition, a portion of the second backplate insulation film 330 will be removed by means of photolithography and RIE in order to form the four upper electrode contacts 321*b*, 322*b*, 323*b*, 324*b* (the four upper electrode contacts are not shown in the drawings). Then, aluminum will be deposited by sputtering, and the lower electrode terminals 141*c*, 142*c*, 143*c*, 144*c* (the four lower electrode terminals are not shown in the drawing), the four upper electrode terminals 321*c*, 322*c*, 323*c*, 324*c* (the four upper electrode terminals are not shown in the drawing), and the silicon film electrode terminal 145*c* (not shown in the drawing) will be formed by means of photolithography and RIE.

Figure 26:
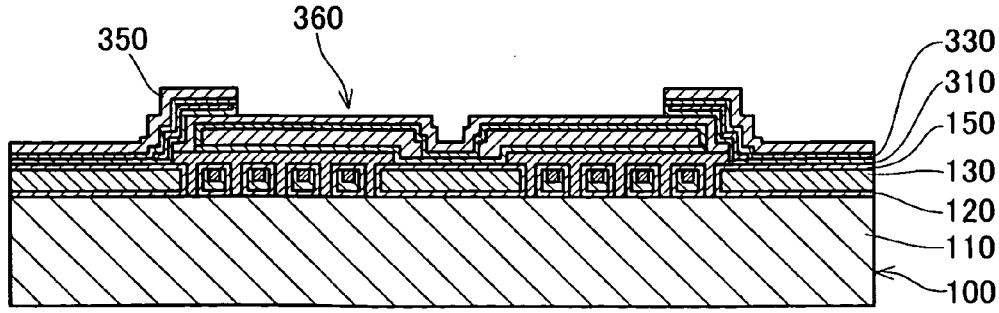

Next, as shown in FIG. 26, a silicon nitride film (PE-SiN) third backplate insulation film 350 that is deposited by means of plasma CVD will be formed on the second backplate insulation film 330.

Next, a portion of the third backplate insulation film 350, the second backplate insulation film 330, and the first backplate insulation film 310 will be removed by means of photolithography and RJE in order to form an etching hole 360 that reaches the second sacrifice layer 260. Simultaneously with the formation of the etching hole 360, a window will be opened so that wire bonding can be performed on the four electrode terminals (not shown in the drawing), the four upper electrode terminals (not shown in the drawing), and the silicon film electrode (not shown in the drawing).

Note that the steps of forming the first backplate insulation film 310, the second backplate insulation film 330, and the third backplate insulation film 350 corresponds to "forming backplate layer" recited in the claims.

Figure 27:
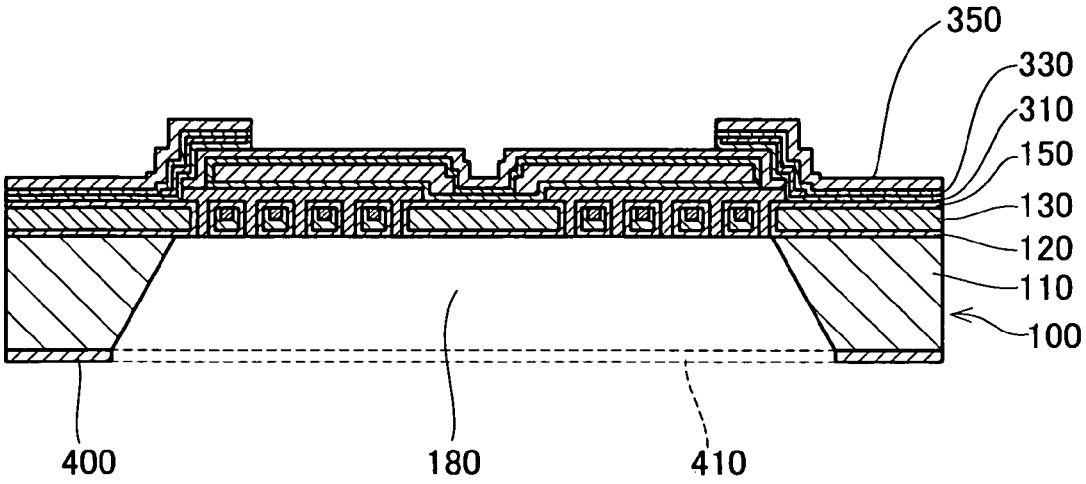

Next, as shown in FIG. 27, a PE-SiN silicon substrate etching mask 400 will be formed on the rear surface of the silicon substrate 110. Then, an etching hole 410 will be formed by means of photolithography and RIE. Then, a tetramethyl ammonium hydroxide solution will be employed to perform crystal anisotropy etching of an etching portion 180 of the silicon substrate 110.

Finally, xenon difluoride ($XeF_2$) will be employed to etch and remove the second sacrifice layer 260 and the first sacrifice layer 170. Thus, as shown in FIG. 16(*b*), a circular diaphragm 200 supported in the center portion thereof, a backplate 190 having air holes 152, and an upper backplate 300 will be formed.

Note that the step of etching and removing the first sacrifice layer corresponds to "removing the sacrifice layer" recited in the claims, and the step of etching and removing the second sacrifice layer corresponds to "removing the second sacrifice layer" recited in the claims.

Embodiment 8

The method of manufacturing of the embodiment 7 is a method of manufacturing a microphone in which the entire diaphragm 200 is an electrode. Next, a method of manufacturing will be described as the embodiment 8, which can form a plurality of electrodes (one of the electrodes of a plurality of capacitors) on both surfaces of the diaphragm.

Most of the steps of the embodiment 8 are the same as the steps of the embodiment 7. Thus, only the different will be described.

Figure 28:
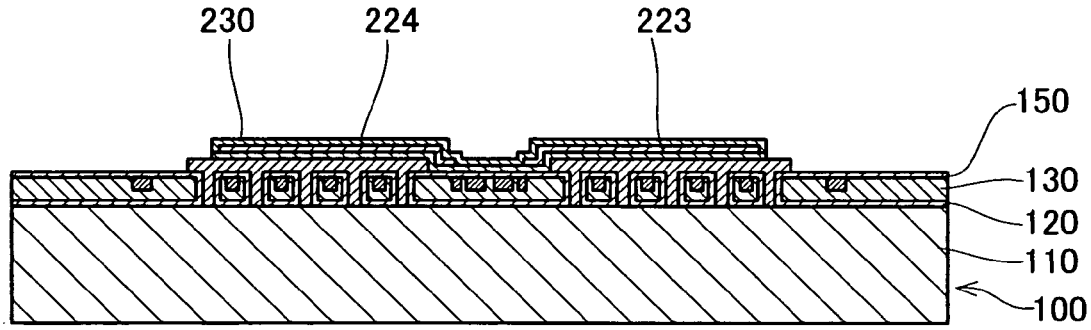
FIG. 28 and FIG. 29 are drawings that depict the manufacturing steps of the microphone of eighth embodiment.
Figure 29:
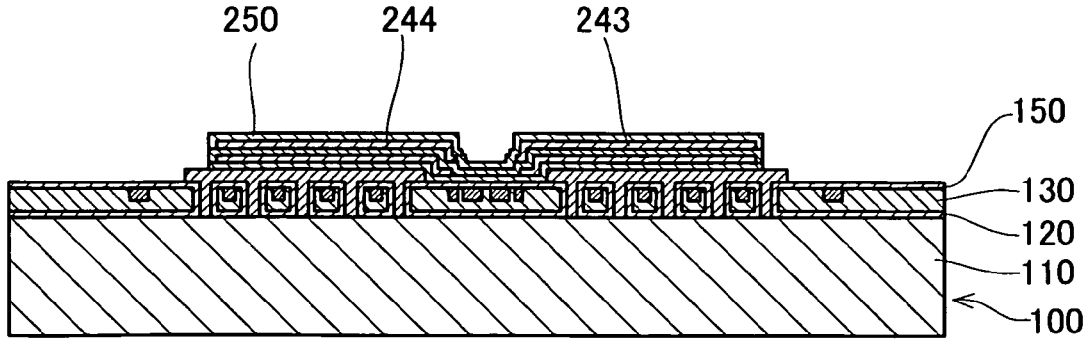

The method of manufacturing of the embodiment 8 replaces the steps in the method of manufacturing of the embodiment 7 shown in FIG. 22 with the steps shown in FIGS. 28 and 29.

The steps shown in FIG. 28 will be performed after the steps described in FIG. 21.

In this step, amorphous silicon (a-Si) lower diaphragm electrodes (223 etc.) that are deposited by means of low pressure CVD will be formed on the first diaphragm insulation film 210, phosphorous will be ion implanted therein, and an active anneal will be performed. Thus, the a-Si will become poly-Si having conductivity. In other words, they can be made to function as electrodes.

Next, the lower diaphragm electrodes will be patterned by means of photolithography and RIE in order to form the four lower diaphragm electrodes 221, 222, 223, 224 (221 and 222 are not shown in the drawing).

Next, an NSG intermediate diaphragm insulation film 230 will be formed so as to cover the lower diaphragm electrodes 220, and patterning will be performed by means of photolithography and RTE. Then, a portion of the trench etching mask film 150, the first diaphragm insulation film 210, and the intermediate diaphragm insulation film 230 formed on the four upper diaphragm electrode leads (not shown in the drawing) will be removed by means of photolithography and RIE in order to form four upper diaphragm electrode first contacts (not shown in the drawing).

Next, as shown in FIG. 29, a-Si upper diaphragm electrodes (241 etc.) will be formed on the intermediate diaphragm insulation film 230. Thereafter, phosphorous will be ion implanted and an active anneal will be performed. Thus, the a-Si will becomes poly-Si having conductivity. In other words, they can be made to function as electrodes.

Next, the upper diaphragm electrodes will be patterned by means of photolithography and RIE in order to form the four upper diaphragm electrodes 241, 242, 243, 244 (241 and 242 are not shown in the drawing). Then, an NSG second diaphragm insulation film 250 will be formed so as to cover the upper diaphragm electrodes 240, and patterning will be performed by means of photolithography and RIE.

The steps that follow thereafter are the same as the steps of FIG. 23 in the embodiment 7.

The embodiments of the present invention are described above.

The present invention provides a microphone that can identify the direction of the sound source with one diaphragm. In addition, the present invention provides a microphone that can detect only acoustic waves propagated from a predetermined direction with one diaphragm. Furthermore, the present invention provides a method of manufacturing a microphone having a diaphragm supported at the center portion thereof. The method uses semiconductor process technology to manufacture a diaphragm supported at the center portion thereof that is suitable for the microphone described above.

When a diaphragm supported on the center portion thereof vibrates for a long period of time, the initial state thereof will change due to fatigue. The initial state is the shape of the diaphragm or the tilt angle of the entire diaphragm with respect to the support portion. If the initial state of the diaphragm changes, the accuracv on identifying the direction of the sound source will decline. The possibility that the initial state of the diaphragm will change is particularly high when an extremely small diaphragm is to be manufactured with semiconductor processes as shown in the embodiments. This is because increasing the strength of the diaphragm will be difficult when an extremely small diaphragm is to be manufactured with semiconductor processes.

According to the embodiments of the present invention, vibration of the diaphragm will be suppressed while identifying the direction of the sound source based on the vibration suppression force. By inhibiting vibration of the diaphragm, it will be easy to keep the diaphragm in its initial state. The durability of the microphone that can identify the direction of the sound source can be improved. Even if vibrations of the diaphragm are suppressed, the direction of the sound source can be identified from the vibration suppression force. Because of the technical features that suppress the vibration of the diaphragm, the durability of the microphone can be improved and the direction of the sound source can be identified.

According to the present invention, the following effects can be further obtained by inhibiting vibration of the diaphragm while identifying the direction of the sound source.

(1) Even if acoustic waves having large amplitudes are received, the diaphragm will not be heavily vibrated. Only the quantity of electricity output to each actuator by the controller will increase. Therefore, the dynamic range of the acoustic waves capable of being received by the microphone can be increased.

(2) By controlling the displacement of each position of the diaphragm due to applying the bias electric energy to each actuator, the initial state of the diaphragm can be adjusted to design. Variation in the initial state of the diaphragm will be produced by manufacturing errors or changes over time. This variation can be detected by detecting the signals of the sensors arranged in each position of the diaphragm. The displacement at each position of the diaphragm can be controlled by the actuators such that the variation will become substantially zero. The value of electric energy applied to the actuator at this point is stored as a bias value. The direction of the sound source will be identified by the value subtracting the bias value from the value of electric energy applied to each actuator for suppressing vibration of the diaphragm. The bias value will not effect the identification of the direction of the sound source. According to the embodiments of the present invention, it will not be necessary to specially supplement the control with the bias value. A microphone that does not complicate the structure, and that inhibits variations in the diaphragm, can be achieved.

At this point, an ideal microphone can be achieved with a configuration in which the capacitors are arranged on both sides of the diaphragm. Each position of the diaphragm can be kept in the initial state by adjusting the size of the electrostatic attraction force by means of the capacitors arranged on both sides of the diaphragm.

In addition, not allowing a diaphragm that receives acoustic waves to vibrate, and receiving acoustic waves, is a fundamental contradiction. In the present invention, as described above, a microphone that makes these two contradictory functions compatible can be achieved.

In addition, as depicted in the embodiments, a microphone in which capacitors are formed as sensors between electrodes arranged on both sides of the diaphragm and electrodes arranged on the diaphragm, is preferably manufactured by means of manufacturing steps that include the following steps.

(1) A step that forms a plurality of first electrode layers on the surface layer of a substrate, in which the first electrode layers are arranged around the periphery of a predetermined region of the surface layer.

(2) A step that forms a first sacrifice layer that covers the first electrode layers and does not cover the predetermined region.

(3) A step that forms a diaphragm layer that covers the first sacrifice layer and the predetermined region exposed in the center of this sacrifice layer.

(4) A step that forms a second sacrifice layer on the diaphragm layer, and comes into contact with the first sacrifice layer at the periphery of the diaphragm layer.

(5) A step that forms a plurality of second electrode layers on the second sacrifice layer, in which the second electrode layers are arranged around the periphery of the predetermined region.

(6) A step that forms an upper backplate layer on the second electrode layers, so that the upper backplate layer comes into contact with the surface layer at the periphery of the second sacrifice layer.

(7) A step that removes the first sacrifice layer and the second sacrifice layer by means of an etchant.

A microphone in which electrodes are arranged on both sides of a diaphragm supported on the center portion thereof can be manufactured by means of steps that include the steps described above.

Here, the steps shown in FIG. 18 correspond to step (1). The steps shown in FIG. 21 correspond to step (2). The steps shown in FIG. 22 correspond to step (3). The steps shown in FIG. 24 correspond to step (4). The steps shown in FIG. 25 correspond to steps (5) and (6).

Although the embodiments of the present invention are described in detail above, these are simply illustrations, and do not limit the scope of the claims. Various modifications and changes to the specific embodiments illustrated above are included within the technical scope of the disclosure of the claims.

In addition, the technological elements described in the present specification or drawings exhibit technological utility either alone or in various combinations, and are not to be limited to the combination of the claims disclosed at the time of application. Furthermore, the technology illustrated in the present specification or drawings simultaneously achieves a plurality of objects, and the achievement of even one object from amongst these has technological utility.

What is claimed is:

1. A microphone comprising:

a diaphragm supported at a center thereof, and which vibrates when the diaphragm receives acoustic waves;

first electrode pairs, each of the first electrode pairs having a first electrode and a second electrode;

second electrode pairs, each of the second electrode pairs having a third electrode and a fourth electrode; and a controller; wherein:

the first electrodes of the first electrode pairs are arranged on a surface of the diaphragm at positions distributed around the center of the diaphragm;

each of the second electrodes of the first electrode pairs is arranged at a position facing a uniquely corresponding first electrode of the first electrode pairs to form a gap between each of the second electrodes of the first electrode pairs and the corresponding first electrode of the first electrode pairs, each of the first electrode pairs forming a first capacitor;

the third electrodes of the second electrode pairs are arranged on a surface of the diaphragm at positions distributed around the center of the diaphragm; and each of the fourth electrodes of the second electrode pairs is arranged at a position facing a uniquely corresponding third electrode of the second electrode pairs to form a gap between each of the fourth electrodes of the second electrode pairs and the corresponding third electrode of the second electrode pairs, each of the second electrode pairs forming a second capacitor;

the controller applies electric energy to each of the first capacitors and each of the second capacitors;

the controller applies predetermined electric energy to each of the first capacitors;

the controller detects the capacitance of each of the first capacitors;

the controller applies electric energy to each of the second capacitors, and each electric energy applied to the corresponding second capacitor is independently controlled such that a detected capacitance of each first capacitor is maintained at a constant value; and the controller identifies a direction along which the acoustic wave propagates based on values of the electric energies, each electric energy being applied to each of the second capacitors.

2. A microphone as in claim 1, wherein the first electrode pairs are arranged on one side of the diaphragm, and the second electrode pairs are arranged on an other side of the diaphragm.

3. A microphone as in claim 1, wherein both of the first electrode pairs and the second electrode pairs are arranged on a same side of the diaphragm.

4. A microphone as in claim 1, wherein the controller identifies the direction from a phase difference between the electric energies, each electric energy being applied to each of the second capacitors.

5. A microphone as in claim 1, wherein:

the controller applies bias electric energy to each of the second capacitors so that the capacitances of the first capacitors are to be substantially equal to each other when the diaphragm does not vibrate;

the controller calculates a value subtracting a value of each bias electric energy from a value of the electric energy being applied to the corresponding second capacitor while the diaphragm vibrates; and the controller identifies the direction from the calculated values.

6. A microphone as in claim 1, wherein the controller outputs an electric signal corresponding to the electric energy being applied to one of the second capacitors when the identified direction is substantially equal to a predetermined direction.

7. A microphone as in claim 1, wherein the first electrode pairs are arranged on a circle around the center of the diaphragm at substantially equal intervals.

8. A microphone as in claim 1, wherein the second electrode pairs are arranged on a circle around the center of the diaphragm at substantially equal intervals.

9. A microphone as in claim 1, wherein a number of the first electrode pairs is the same as a number of the second electrode pairs, each first electrode pair and corresponding second electrode pair being aligned when viewed along a direction perpendicular to the diaphragm.

10. A microphone as in claim 1, wherein the diaphragm has a substantially circular shape.

11. A microphone as in claim 1, wherein the center of the diaphragm and a periphery of the diaphragm are connected with a gimbal.

12. A microphone comprising:

a diaphragm supported at a center thereof, and which vibrates when the diaphragm receives acoustic waves;

first electrode pairs, each of the first electrode pairs having a first electrode and a second electrode;

second electrode pairs, each of the second electrode pairs having a third electrode and a fourth electrode; and a controller; wherein:

the first electrodes of the first electrode pairs are arranged on a surface of the diaphragm at positions distributed around the center of the diaphragm;

each of the second electrodes of the first electrode pairs is arranged at a position facing a uniquely corresponding first electrode of the first electrode pairs to form a gap between each of the second electrodes of the first electrode pairs and the corresponding first electrode of the first electrode pairs, each of the first electrode pairs forming a first capacitor;

the third electrodes of the second electrode pairs are arranged on a surface of the diaphragm at positions distributed around the center of the diaphragm; and each of the fourth electrodes of the second electrode pairs is arranged at a position facing a uniquely corresponding third electrode of the second electrode pairs to form a gap between each of the fourth electrodes of the second electrode pairs and the corresponding third electrode of the second electrode pairs, each of the second electrode pairs forming a second capacitor;

the controller applies electric energy to each of the first capacitors and each of the second capacitors;

the first electrode pairs are arranged on one side of the diaphragm, and the second electrode pairs are arranged on an other side of the diaphragm;

the controller has a bridge circuit with the first capacitors and the second capacitors, the bridge circuit having a pair of input terminals and a pair of output terminals;

the controller applies predetermined electric energy to the first capacitors and the second capacitors via the pair of input terminals; and the bridge circuit is formed so as to output an electric signal via the pair of output terminals when capacitances of the first capacitors change with substantially a same phase, the outputted electric signal corresponding to a change of capacitance of at least one of the first capacitors.

13. A microphone as in claim 12, wherein:

the first capacitors that are located within a half region of the diaphragm are connected in series between one input terminal of the bridge circuit and one output terminal of the bridge circuit;

the first capacitors that are located within an other half region of the diaphragm are connected in series between an other input terminal of the bridge circuit and an other output terminal of the bridge circuit;

the second capacitors that are located within the other half region of the diaphragm are connected in series between the one input terminal and the other output terminal; and the second capacitors that are located within the half region of the diaphragm are connected in series between the other input terminal and the one output terminal.

14. A microphone as in claim 12, wherein the first electrode pairs are arranged on a circle around the center of the diaphragm at substantially equal intervals.

15. A microphone as in claim 12, wherein the second electrode pairs are arranged on a circle around the center of the diaphragm at substantially equal intervals.

16. A microphone as in claim 12, wherein a number of the first electrode pairs is the same as a number of the second electrode pairs, each of the first electrode pairs and corresponding second electrode pair being aligned when viewed along a direction perpendicular to the diaphragm.

17. A microphone as in claim 12, wherein the diaphragm has a substantially circular shape in plane.

18. A microphone as in claim 12, wherein the center of the diaphragm and a periphery of the diaphragm are connected with a gimbal.

19. A microphone comprising:

a diaphragm supported at the center thereof, and which vibrates when the diaphragm receives acoustic waves;

sensors distributed around the center of the diaphragm for detecting displacements of the diaphragm at the distributed positions;

actuators distributed around the center of the diaphragm for canceling the detected displacements; and a controller identifying a direction along which the acoustic wave propagates based on values of electric energies applied to the actuators for canceling the displacements of the diaphragm during vibration.

* * * * *